US008287076B2

(12) United States Patent
Kobayashi et al.

(10) Patent No.: US 8,287,076 B2
(45) Date of Patent: Oct. 16, 2012

(54) CONVEYING DISTANCE CONTROL DEVICE, RECORDING APPARATUS, CONVEYING DISTANCE CONTROL METHOD, AND STORAGE MEDIUM

(75) Inventors: Masato Kobayashi, Kanagawa (JP); Nobuyuki Satoh, Kanagawa (JP); Norikazu Taki, Kanagawa (JP); Tatsuhiko Okada, Saitama (JP); Daisuke Sawada, Saitama (JP); Daisaku Horikawa, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 212 days.

(21) Appl. No.: 12/923,216

(22) Filed: Sep. 9, 2010

(65) Prior Publication Data

US 2011/0063356 A1 Mar. 17, 2011

(30) Foreign Application Priority Data

Sep. 14, 2009 (JP) ..... 2009-212306

(51) Int. Cl.
*B41J 29/38* (2006.01)

(52) U.S. Cl. ..... 347/16; 347/14; 347/19; 347/101

(58) Field of Classification Search ..... 347/5, 14, 347/15, 19, 101, 104, 105, 106
See application file for complete search history.

(56) References Cited

U.S. PATENT DOCUMENTS

| | | | | |
|---|---|---|---|---|
| 7,055,928 | B2 * | 6/2006 | Ishibashi et al. | 347/19 |
| 2009/0180156 | A1 | 7/2009 | Yoshimaru et al. | |
| 2009/0195843 | A1 | 8/2009 | Satoh et al. | |
| 2009/0237437 | A1 | 9/2009 | Uchida | |
| 2009/0316164 | A1 | 12/2009 | Takahashi et al. | |

FOREIGN PATENT DOCUMENTS

| | | |
|---|---|---|
| JP | 2007-261262 | 10/2007 |
| JP | 2009-066900 | 4/2009 |

* cited by examiner

*Primary Examiner* — Juanita D Jackson
(74) *Attorney, Agent, or Firm* — Harness, Dickey & Pierce, P.L.C.

(57) ABSTRACT

A conveying distance control device includes a conveying roller; a first detecting unit detecting rotational positions of the conveying roller; a line sensor sequentially detecting marks arranged on a test chart; a calculation unit, and a control unit. The calculation unit calculates a skew angle between a line passing through positions of a first mark and a second mark and a conveying direction of the conveying roller. The control unit obtains conveying distance errors indicating differences between corrected conveying distances not including errors caused by the skew angle and theoretical conveying distance of the marks in association with the rotational positions of the conveying roller, calculates a correction value for correcting a conveying distance of the conveying roller based on relationships between the conveying distance errors and the rotational positions of the conveying roller, and controls the conveying distance of the conveying roller based on the correction value.

9 Claims, 21 Drawing Sheets

FIG.7B WITH ECCENTRICITY

FIG.7A WITHOUT ECCENTRICITY

CONVEYING DISTANCE CONTROL DEVICE, RECORDING APPARATUS, CONVEYING DISTANCE CONTROL METHOD, AND STORAGE MEDIUM

BACKGROUND OF THE INVENTION

1. Field of the Invention

A certain aspect of the present invention relates to a recording apparatus.

2. Description of the Related Art

In an inkjet recording apparatus, ink is jetted onto a recording medium on a platen from a recording head mounted on a carriage being moved back and forth in the main-scanning direction (the carriage moving direction) to form an array of dots on the recording medium. The recording medium is conveyed in the sub-scanning direction (a direction orthogonal to the carriage moving direction) by, for example, a conveying roller, and another array of dots are formed on the recording medium in the main-scanning direction. This process is repeated to form an image on the recording medium.

When a recording medium is conveyed using a conveying roller in such an inkjet recording apparatus, the distance (hereafter called the conveying distance) by which the recording medium is conveyed varies depending on various factors such as an assembly error of the conveying roller, eccentricity of the conveying roller, and types of the recording medium. If the conveying distance is not constant, dots may be formed in a position different from the intended (ideal) position on the recording medium.

Japanese Patent Application Publication No. 2007-261262 discloses a technology intended to solve the above problem. In the disclosed technology, a test pattern is formed on a recording medium, a positional error of a recording medium in the sub-scanning direction (conveying direction) is detected based on the test pattern, and the amount of rotation of the conveying roller is corrected based on the detected positional error.

However, in the disclosed technology, the test pattern itself becomes inaccurate if a recording head for forming the test pattern includes clogged nozzles and/or skewed nozzles. If a positional error of a recording medium is detected based on an inaccurate test pattern, it is not possible to accurately correct the amount of rotation of the conveying roller.

SUMMARY OF THE INVENTION

According to an aspect of the present invention, a conveying distance control device includes a conveying roller conveying a recording medium; a first detecting unit detecting rotational positions of the conveying roller; a line sensor sequentially detecting marks arranged on a test chart being conveyed by the conveying roller; a calculation unit; and a control unit. The calculation unit calculates a skew angle between a line passing through positions of a first mark and a second mark and a conveying direction of the conveying roller based on positional information of the marks detected by the line sensor. The control unit obtains corrected conveying distances by removing errors caused by the skew angle from actual conveying distances of the marks detected by the line sensor, obtains conveying distance errors indicating differences between the corrected conveying distances and a theoretical conveying distance of the marks in association with the rotational positions of the conveying roller, calculates a correction value for correcting a conveying distance of the conveying roller based on relationships between the conveying distance errors and the rotational positions of the conveying roller, and controls the conveying distance of the conveying roller based on the calculated correction value.

Another aspect of the present invention provides a conveying distance control method performed by a conveying distance control device. The method includes the steps of detecting, by a first detecting unit, rotational positions of a conveying roller for conveying a recording medium; sequentially detecting, by a line sensor, marks arranged on a test chart being conveyed by the conveying roller; calculating, by a calculation unit, a skew angle between a line passing through positions of a first mark and a second mark and a conveying direction of the conveying roller based on positional information of the marks detected by the line sensor; obtaining, by a control unit, corrected conveying distances by removing errors caused by the skew angle from actual conveying distances of the marks detected by the line sensor; obtaining, by the control unit, conveying distance errors indicating differences between the corrected conveying distances and a theoretical conveying distance of the marks in association with the rotational positions of the conveying roller; calculating, by the control unit, a correction value for correcting a conveying distance of the conveying roller based on relationships between the conveying distance errors and the rotational positions of the conveying roller; and controlling, by the control unit, the conveying distance of the conveying roller based on the calculated correction value.

BRIEF DESCRIPTION OF THE DRAWINGS

FIGS. 7A through 7C are drawings used to describe a case where the test chart 100 is not skewed;

DESCRIPTION OF THE PREFERRED EMBODIMENTS

Preferred embodiments of the present invention are described below with reference to the accompanying drawings.

Conveying Distance Control Device

A conveying distance control device according to an embodiment of the present invention is described below with reference to FIGS. 2, 3, 7, 8, 10, 11, and 14.

Figure 2:
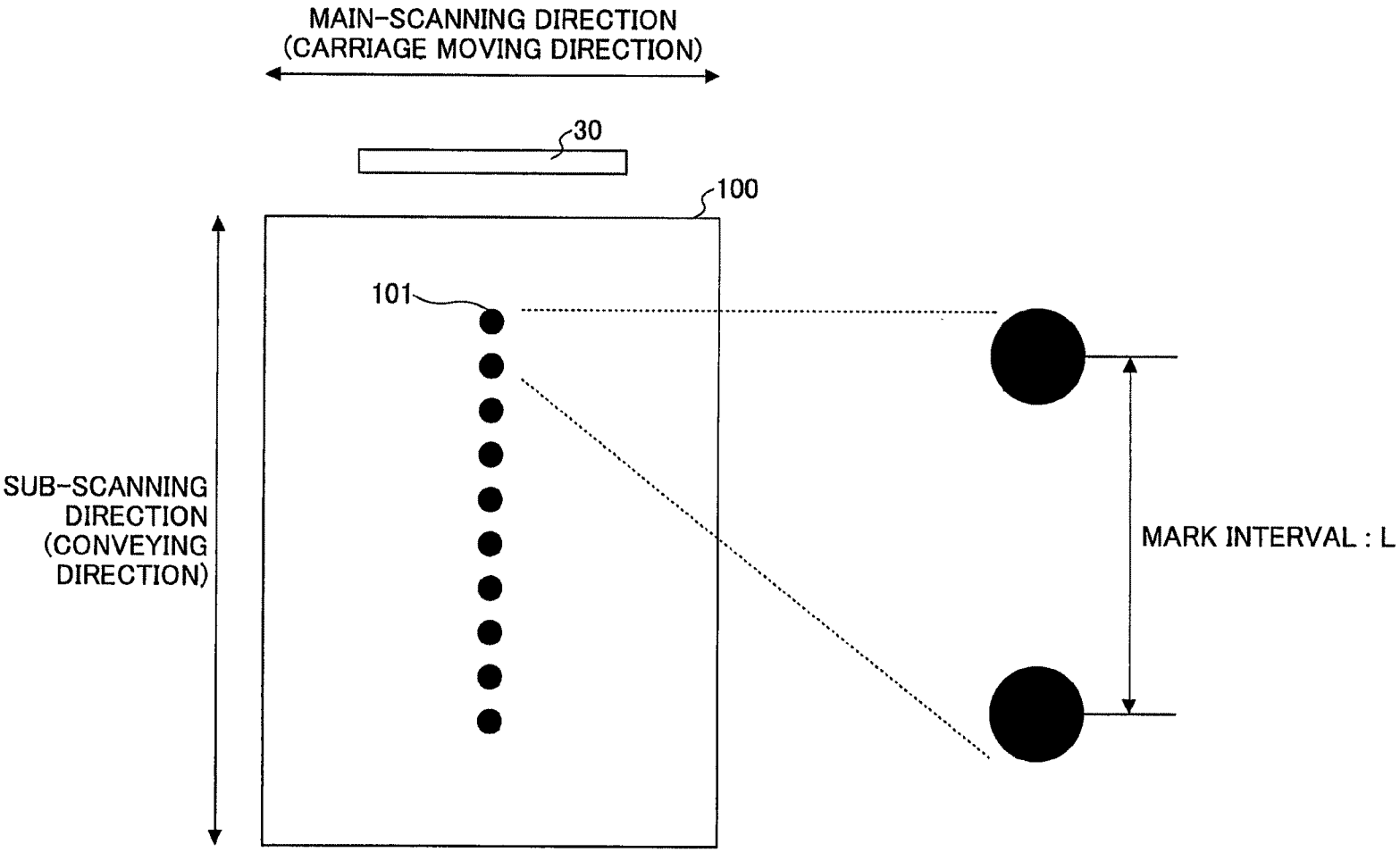
FIG. 2 is a drawing illustrating a test chart 100.
Figure 3:
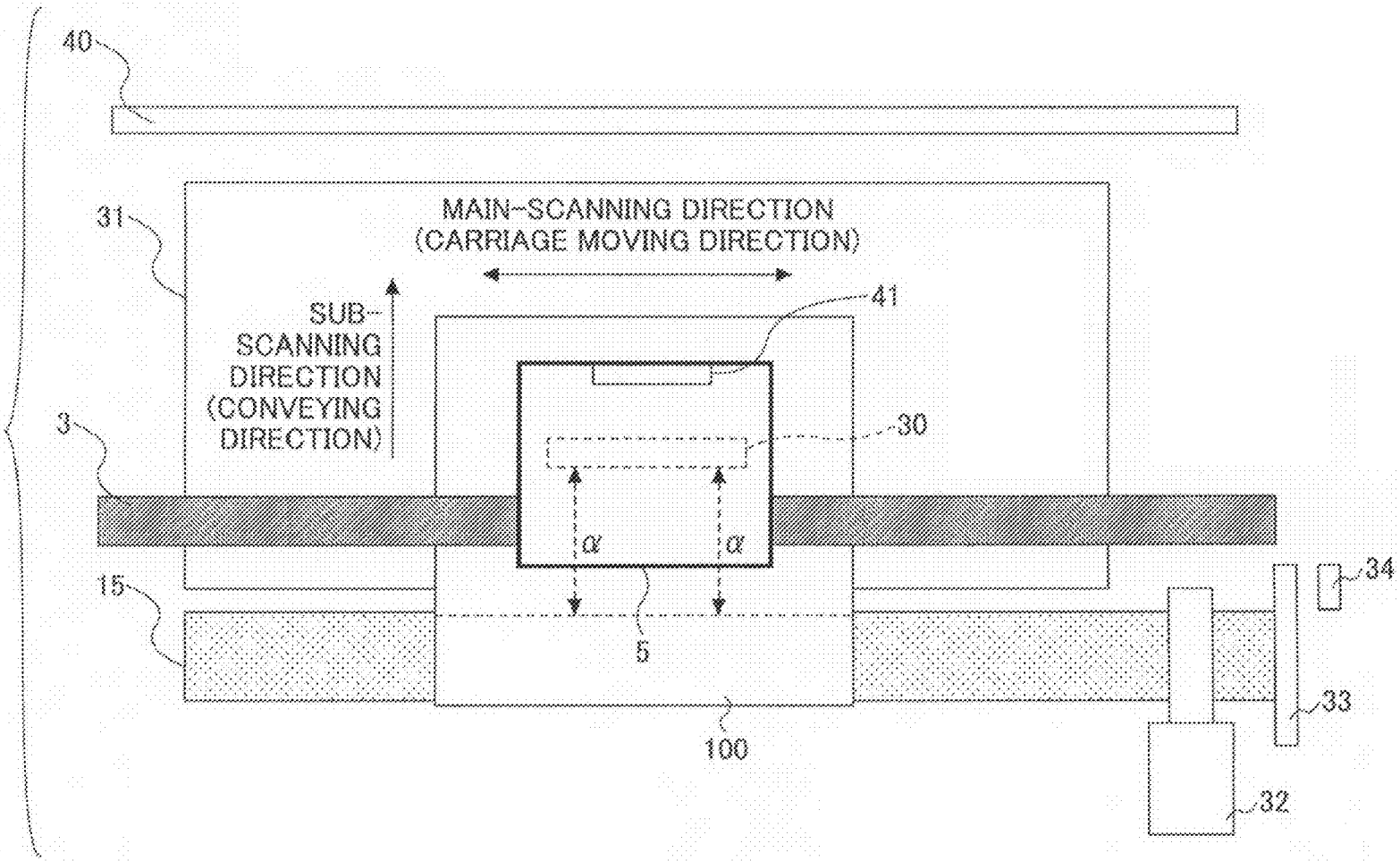
FIG. 3 is a drawing illustrating a carriage 5 and surrounding components of a recording apparatus.
Figure 10A:
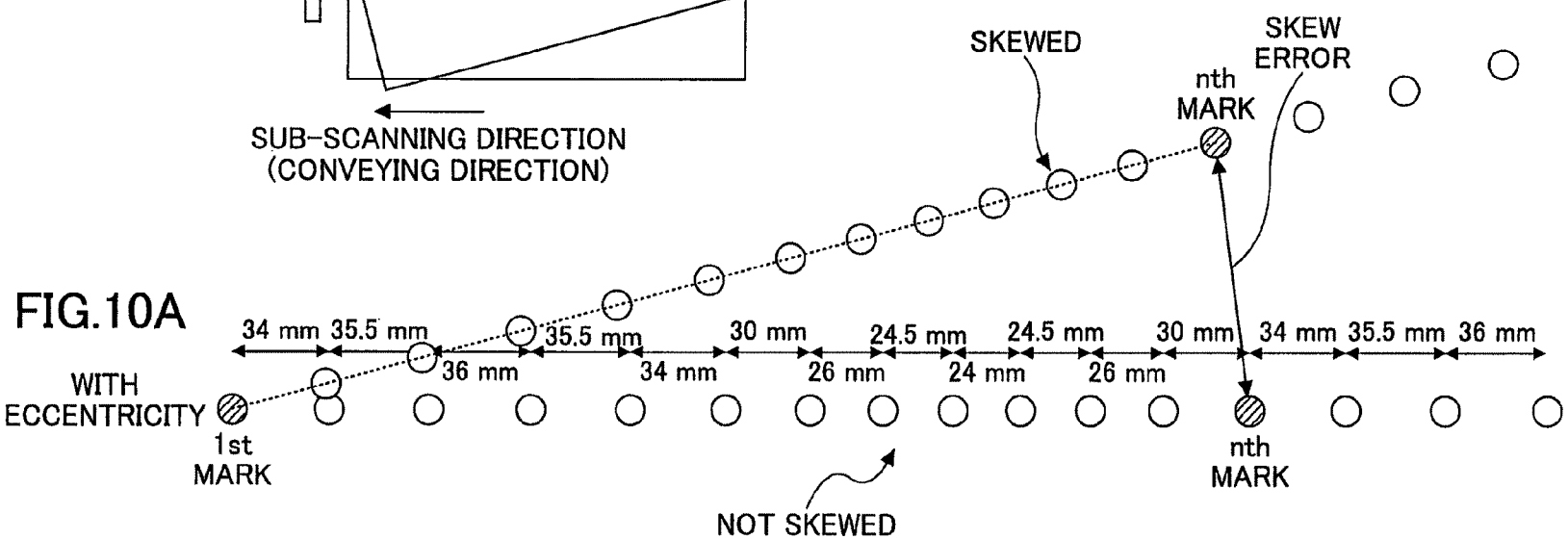
Figure 11:
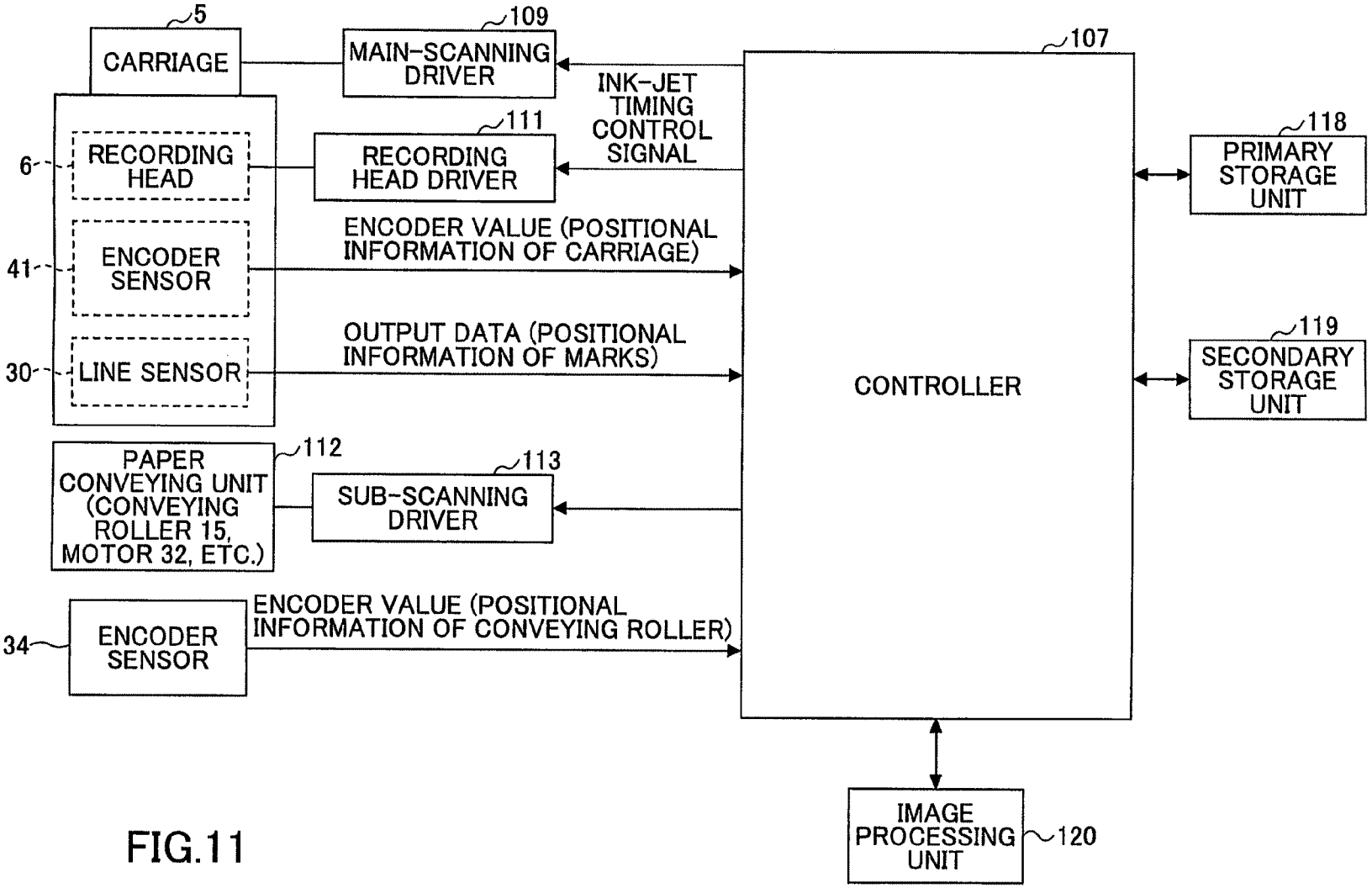
FIG. 11 is a block diagram illustrating a control mechanism of a recording apparatus.

As shown in FIGS. 3 and 11, the conveying distance control device of this embodiment includes a conveying roller 15, a first detecting unit (encoder sensor 34); a line sensor 30, a calculation unit (controller 107), and a control unit (controller 107). The conveying roller 15 conveys a recording medium 16 (see FIG. 1). The first detecting unit detects rotational positions of the conveying roller 15. The line sensor 30 sequentially detects marks 101 arranged on a test chart 100 (see FIG. 2) being conveyed by the conveying roller 15. The test chart 100 is used to adjust the conveying distance of the conveying roller 15. The calculation unit calculates, based on positional information of the marks 101 detected by the line sensor 30 (more specifically, obtained based on detection results of the line sensor 30), a skew angle θ between a line A passing through two marks 101 and a conveying direction B of the conveying roller 15 (see FIG. 14). The control unit obtains corrected conveying distances (positional information of the marks 101 shown in FIG. 7B (with eccentricity)) by removing the influence (errors) caused by the skew angle θ from actual conveying distances (shown in FIG. 10A) of the marks 101 detected by the line sensor 30 (more specifically, obtained based on detection results of the line sensor 30). Next, the control unit obtains conveying distance errors indicating differences between the corrected conveying distances and a theoretical conveying distance of the marks 101 (positional information of the marks 101 shown in FIG. 7A (without eccentricity)) in association with the rotational positions of the conveying roller 15'. Based on the relationships between the conveying distance errors and the rotational positions of the conveying roller 15 (see FIG. 8), the control unit calculates a correction value for correcting the conveying distance of the conveying roller 15 and controls the conveying distance of the conveying roller 15 based on the calculated correction value.

With the above configuration, the conveying distance control device of this embodiment is able to reduce the variation in the conveying distance of the conveying roller 15. Details of the conveying distance control device are described below with reference to the accompanying drawings. In the descriptions below, it is assumed that the conveying distance control device is provided in a recording apparatus. Also in the descriptions below, it is assumed that the calculation unit and the control unit are implemented by the controller 107. Needless to say, the calculation unit and the control unit may be implemented as separate components.

First Embodiment

Mechanical Configuration of Recording Apparatus

Figure 1:
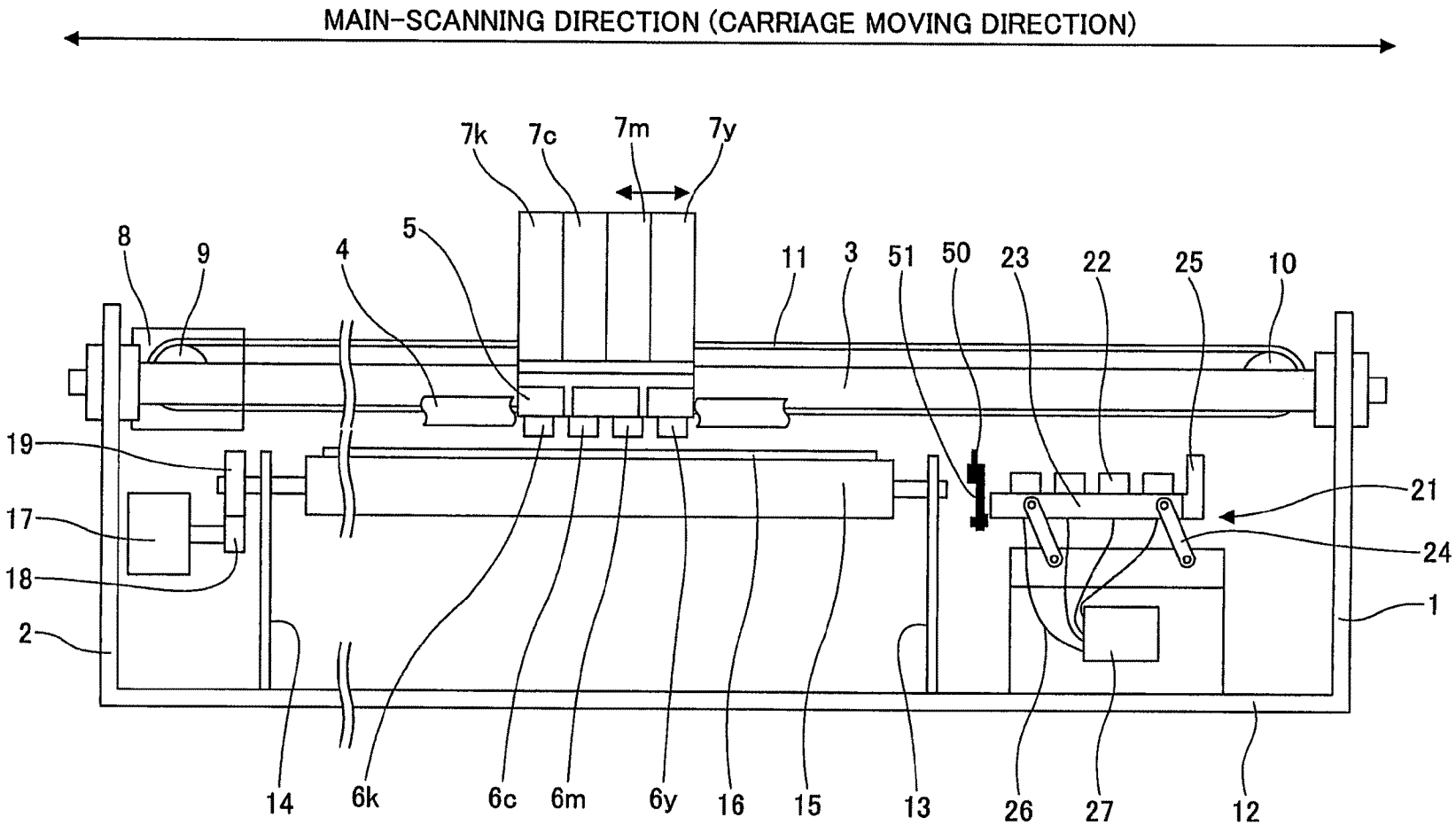
FIG. 1 is a drawing illustrating a mechanical configuration of a recording apparatus according to an embodiment of the present invention.

An exemplary mechanical configuration of a recording apparatus of this embodiment is described below with reference to FIG. 1.

The recording apparatus of this embodiment includes side boards 1 and 2; a primary guide rod 3 and a secondary guide rod 4 arranged substantially in parallel to each other and extended laterally between the sideboards 1 and 2; and a carriage 5 supported by the primary guide rod 3 and the secondary guide rod 4 so as to be slidable in the main scanning direction.

Four recording heads 6 (may be collectively called the recording head 34) for jetting yellow (Y), magenta (M), cyan (C), and black (K) ink are mounted on the carriage 5 with their ink-jetting surfaces (nozzle surfaces) facing downward. Also, four ink cartridges 7 (may be collectively called the ink cartridge 7) are replaceably mounted on the carriage 5 above the corresponding recording heads 6. The ink cartridges 7 are ink suppliers for supplying ink of the corresponding colors to the recording heads 6. The carriage 5 is connected to a timing belt 11 stretched between a drive pulley (drive timing pulley) 9 rotated by a main-scanning motor 8 and a driven pulley (idler pulley) 10. The carriage 5 is moved in the main-scanning direction (the carriage moving direction) by driving the main-scanning motor 8. As shown in FIG. 3, an encoder sensor 41 is provided on the carriage 5. The encoder sensor 41 obtains encoder values by detecting marks on an encoder sheet 40, and the movement of the carriage 5 in the main-scanning direction is controlled based on the encoder values.

The recording apparatus of this embodiment also includes sub frames 13 and 14 disposed vertically on a bottom plate 12 connecting the side boards 1 and 2. The conveying roller 15 is rotatably supported between the subframes 13 and 14. A sub-scanning motor 17 is provided near the sub frame 14. The rotational force of the sub-scanning motor 17 is transmitted to the conveying roller 15 via a gear 18 fixed to the rotation shaft of the sub-scanning motor 17 and a gear 19 fixed to a shaft of the conveying roller 15.

A maintenance/cleaning mechanism 21 (hereafter called a subsystem 21) for the recording heads 6 is provided between the side board 1 and the sub frame 13. The subsystem 21 includes four capping units 22 for capping the nozzle surfaces of the recording heads 6, a holder 23 for holding the capping units 22, and linking parts 24 for swingably supporting the holder 23. When the carriage 5 is moved in the main-scanning direction and brought into contact with an engaging part 25 of the holder 23, the holder 23 is lifted upward and the nozzle surfaces of the recording heads 6 are capped by the capping units 22. Meanwhile, when the carriage 5 is moved toward the printing area, the holder 23 descends and the capping units 22 are detached from the nozzle surfaces of the recording heads 6.

The capping units 22 are connected via suction tubes 26 to a suction pump 27 and also communicate with the atmosphere via atmospheric openings, atmospheric tubes, and atmospheric valves (not shown). The suction pump 27 discharges suctioned waste liquid (waste ink) into a waste liquid tank (not shown).

A wiper blade 50 for wiping the nozzle surfaces of the recording heads 6 is provided on one side of the holder 23. The wiper blade 50 is attached to a blade arm 51 that is pivoted on the holder 23. The blade arm 51 is caused to swing by the rotation of a cam rotated by a drive unit (not shown).

In the recording apparatus described above, ink is jetted onto the recording medium 16 from the recording heads 6 mounted on the carriage 5 being moved back and forth in the main-scanning direction (the carriage moving direction) to form an array of dots on the recording medium 16. The recording medium 16 is conveyed in the sub-scanning direction (a direction orthogonal to the carriage moving direction) by the conveying roller 15, and another array of dots is formed on the recording medium 16 in the main-scanning direction. This process is repeated to form an image on the recording medium 16.

When conveying the recording medium 16 by rotating the conveying roller 15, the conveying distance varies slightly each time. As a result, the actual recording position (where dots are actually formed) on the recording medium 16 deviates from the intended (ideal) position (where dots need to be formed) on the recording medium 16.

In this embodiment, to obviate the above problem, the test chart 100 as shown in FIG. 2 is used. When the test chart 100 is placed on a paper-feeding unit (not shown) for holding the recording medium 16 and conveyed by rotating the conveying roller 15, the line sensor 30 detects marks 101 arranged on the test chart 100. Based on information obtained by detecting each mark 101 with the line sensor 30, an actual conveying distance of the mark 101 (the actual conveying distance of the conveying roller 15) is calculated. Next, a difference (conveying distance error) between the actual conveying distance of the mark 101 and a theoretical conveying distance of the mark 101 (or the conveying roller 15) is obtained in association with the rotational position of the conveying roller 15. Based on the relationships between the obtained differences (conveying distance errors) and the rotational positions of the conveying roller 15, a correction value(s) for correcting the conveying distance of the conveying roller 15 is calculated and the conveying distance of the conveying roller 15 is controlled based on the calculated correction value. This configuration makes it possible to reduce the variation in the sub-scanning-direction conveying distance of the conveying roller 15. The test chart 100 shown in FIG. 2 is used to adjust the conveying distance of the conveying roller 15. On the test chart 100, the marks (dots) 101 are arranged at a regular interval (mark interval L).

Carriage and Surrounding Components

The carriage 5 and components surrounding the carriage 5 are described below with reference to FIG. 3.

As shown in FIG. 3, the recording apparatus of this embodiment includes the carriage 5, the primary guide rod 3, a platen 31, the conveying roller 15, a motor 32, an encoder wheel 33, and an encoder sensor 34.

Figure 4A:
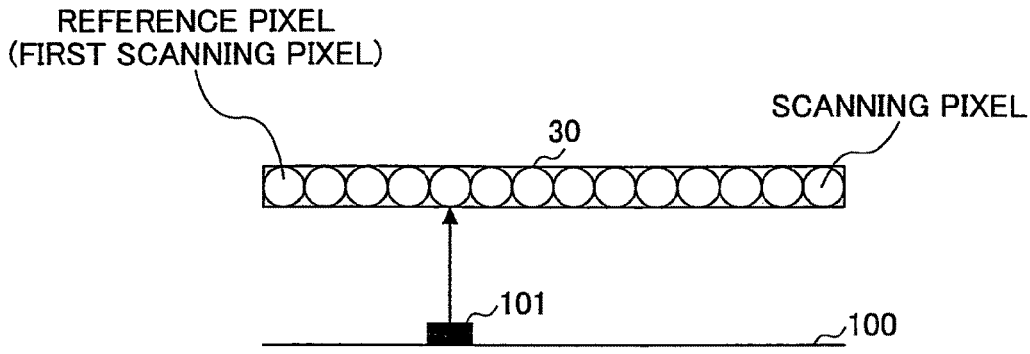
FIGS. 4A through 4C are drawings illustrating a line sensor 30.

The carriage 5 includes the line sensor 30 and the encoder sensor 41. As shown in FIG. 4A, the line sensor 30 includes multiple scanning pixels or detecting elements (in this example, 14 scanning pixels) arranged in the main-scanning direction. With the scanning pixels, the line sensor 30 sequentially detects the marks 101 arranged on the test chart 100 shown in FIG. 2.

Figure 4B:
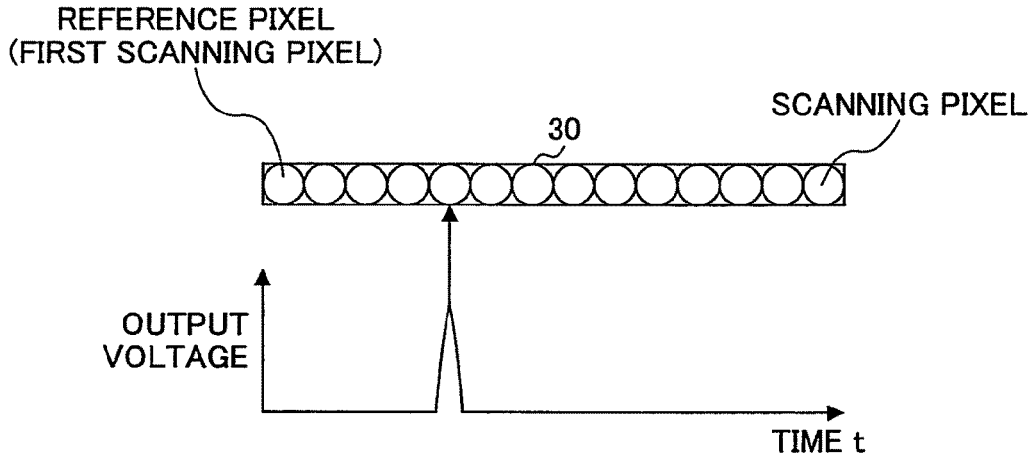
Figure 4C:
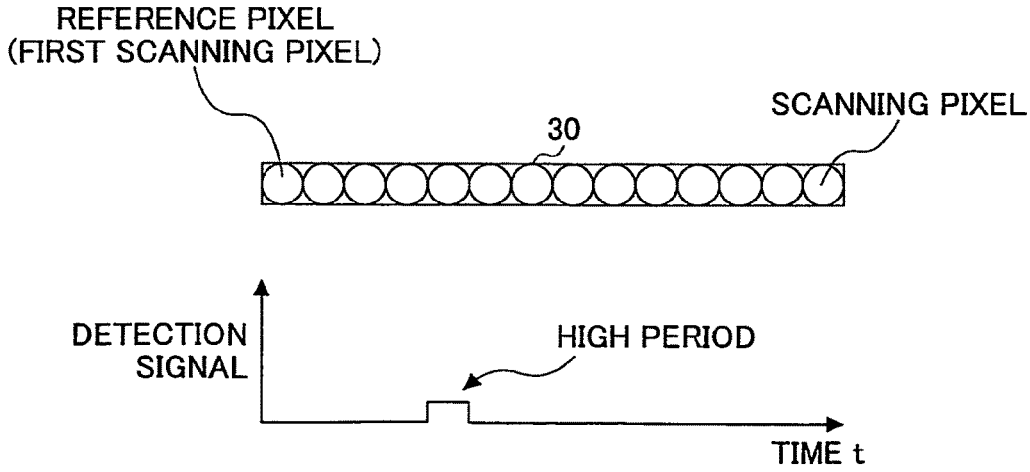

When a scanning pixel of the line sensor 30 detects a mark 101, the output voltage level of the scanning pixel becomes high as shown in FIG. 4B. Accordingly, when a scanning pixel of the line sensor 30 detects a mark 101, the line sensor 30 outputs one line of data (detection signal) including a "high period" as shown in FIG. 4C. The recording apparatus calculates positions (x and y coordinates) of the marks 101 based on lines of data output from the line sensor 30.

Figure 5B:
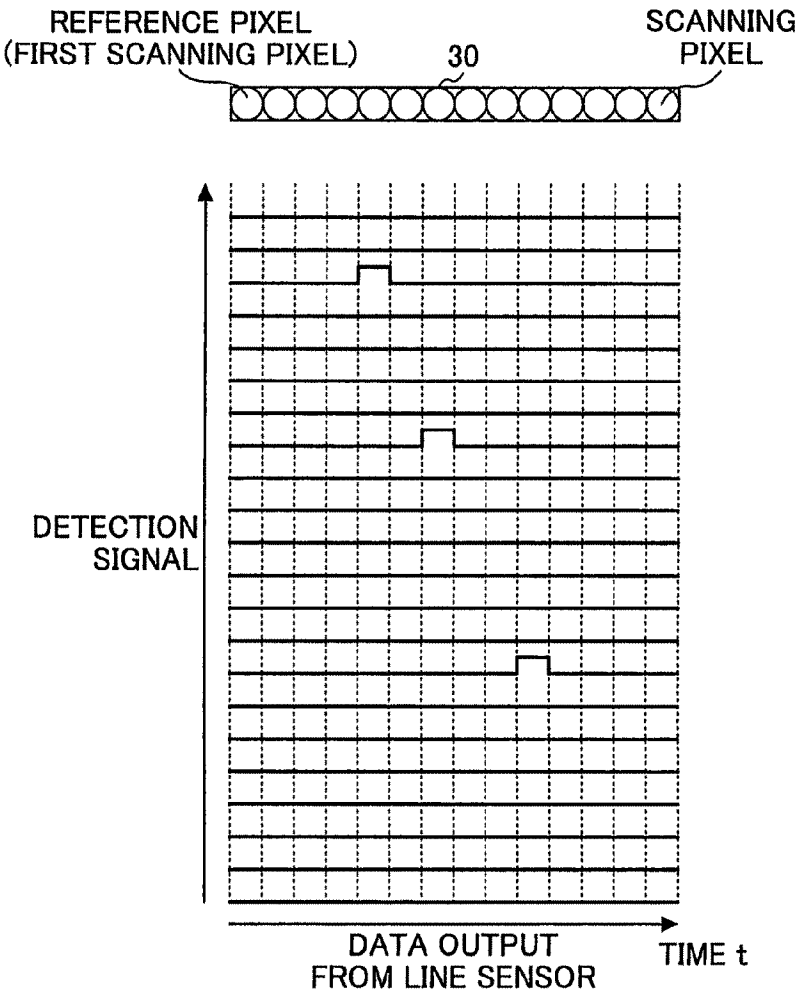
FIGS. 5A and 5B are drawings illustrating calculations of positions of marks 101.
Figure 5A:
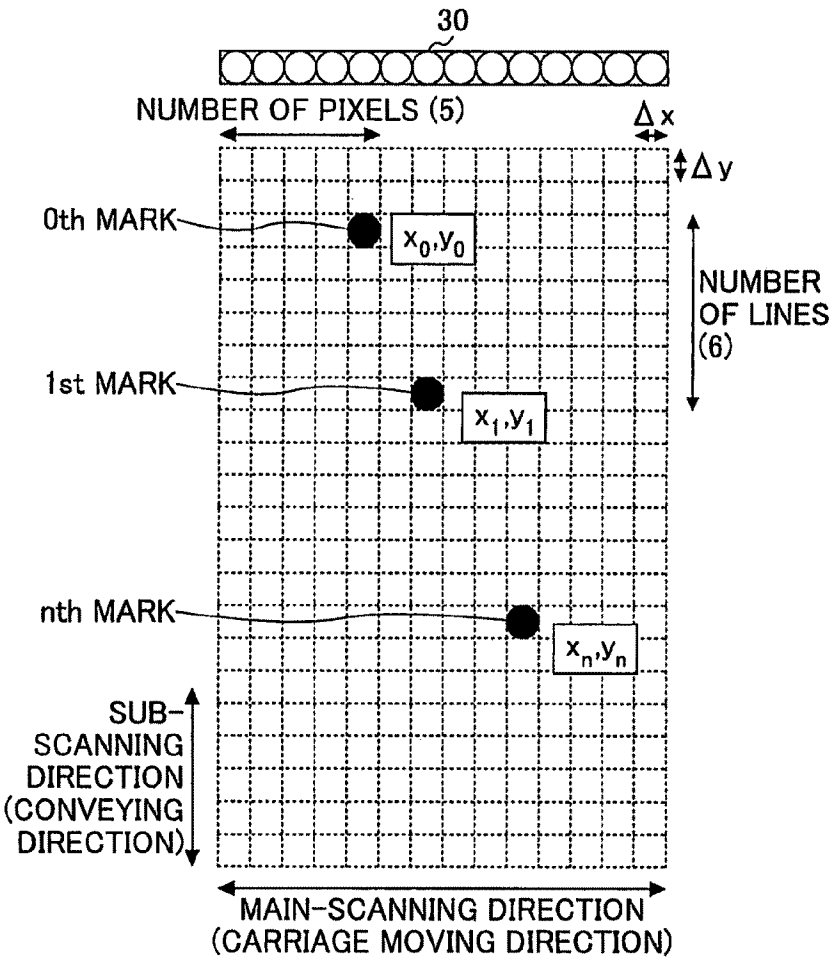

For example, when lines of data as shown in FIG. 5B are output from the line sensor 30, the recording apparatus calculates positions (x and y coordinates) of the marks 101 as shown in FIG. 5A.

The x-coordinate indicates the position of the mark 101 in the main-scanning direction and is calculated by multiplying the pixel size of each scanning pixel by the number of pixels between a reference pixel (first scanning pixel) and the scanning pixel detecting the mark 101 (pixel size X number of pixels). For example, the x-coordinate ($x_0$) of the 0th mark 101 in FIG. 5A is calculated by multiplying a pixel size ($\Delta x$) of each scanning pixel by the number of pixels (5) between the reference pixel and the scanning pixel detecting the 0th mark 101 ($\Delta x \times 5$).

The y-coordinate indicates the position of the mark 101 in the sub-scanning direction and is calculated by multiplying the pixel size by the number of lines scanned by the line sensor 30 until the mark 101 is detected. For example, the y-coordinate ($y_1$) of the 1st mark 101 in FIG. 5A is calculated by multiplying the pixel size ($\Delta y$) by the number of lines (6) from a scanning line where the 0th mark 101 is detected to a scanning line where the 1st mark 101 is detected ($\Delta y \times 6$).

Thus, positions (x and y coordinates) of the marks 101 are calculated based on lines of data output from the line sensor 30.

In this embodiment, it is assumed that the size of the mark 101 formed on the test chart 100 is greater than the pixel size ($\Delta x \times \Delta y$) of each scanning pixel of the line sensor 30. This makes it easier for the scanning pixels of the line sensor 30 to detect the marks 101. If one mark 101 is detected by plural scanning pixels, the position of the mark 101 is calculated based on the position of one of the scanning pixels that outputs the highest voltage level. If plural scanning pixels output the same highest voltage level, the position of the mark 101 is calculated based on the position of one the scanning pixels that is at the center of the scanning pixels.

Any type of sensor may be used as the line sensor 30 as long as it includes multiple scanning elements arranged in the main-scanning direction and can sequentially detect the marks 101 arranged on the test chart 100. Also, the line sensor 30 may be placed in any appropriate position. For example, the line sensor 30 may be combined with the carriage 5 as shown in FIG. 3, or may be provided separately from the carriage 5. In any case, the line sensor 30 needs to be positioned in parallel with the conveying roller 15 such that a distance $\alpha$ between the line sensor 30 and the conveying roller 15 becomes constant as shown in FIG. 3.

The encoder sensor 41 obtains encoder values by detecting marks on the encoder sheet 40. The encoder values are used to control the movement of the carriage 5 in the main-scanning direction.

The platen 31 is a support part for supporting the recording medium 16 being conveyed by the conveying roller 15.

The conveying roller 15, the motor 32, the encoder wheel 33, and the encoder sensor 34 are used to control the conveying distance of the recording medium 16 and the test chart 100.

Figure 6:
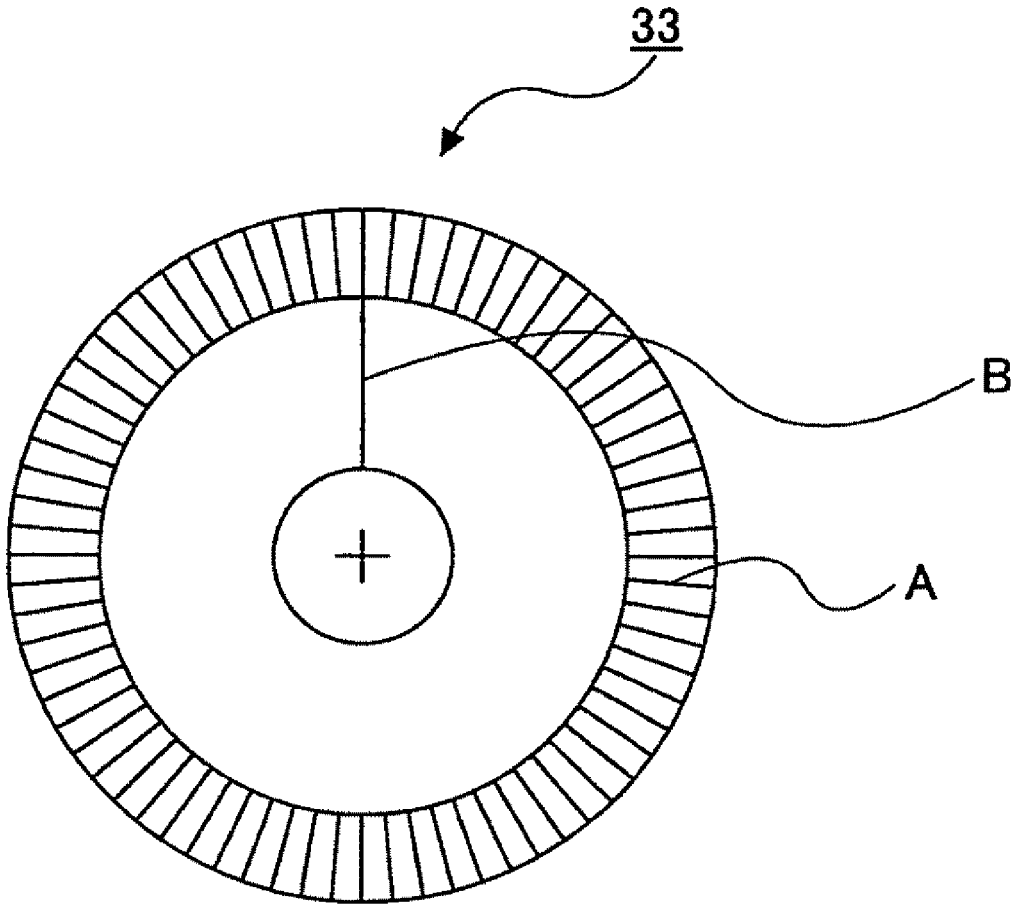
FIG. 6 is a drawing illustrating an encoder wheel 33.

As shown in FIG. 6, the encoder wheel 33 has a pattern A consisting of slits formed along the circumference of the encoder wheel 33 and used to measure the conveying distance of the conveying roller 15, and a pattern B for determining the home position (HP) of the conveying roller 15. The encoder sensor 34 detects the patterns A and B of the encoder wheel 33 and thereby obtains encoder values corresponding to the detected patterns A and B.

In the recording apparatus of this embodiment, the test chart 100 is conveyed in the sub-scanning direction (conveying direction) by the conveying roller 15, the marks 101 arranged on the test chart 100 are detected by the line sensor 30, and actual conveying distances of the marks 101 are calculated. Also, rotational positions (rotation angles) of the conveying roller 15 are calculated based on encoder values that are detected by the encoder sensor 34 when the marks 101 are detected by the line sensor 30. Let us assume that the encoder sensor 34 counts 38400 when the conveying roller 15 rotates once. In this case, the encoder value per 1 degree rotation angle of the conveying roller 15 is 38400/360≈107. Accordingly, when the encoder value obtained from the encoder sensor 34 is 3840, the rotational position (rotation angle) of the conveying roller 15 is 3840/107≈74.8.

Positional Information of Marks 101

Positional information of the marks 101 are described below with reference to FIGS. 7 through 10.

(When Test Chart 100 is not Skewed)

Figure 7C:
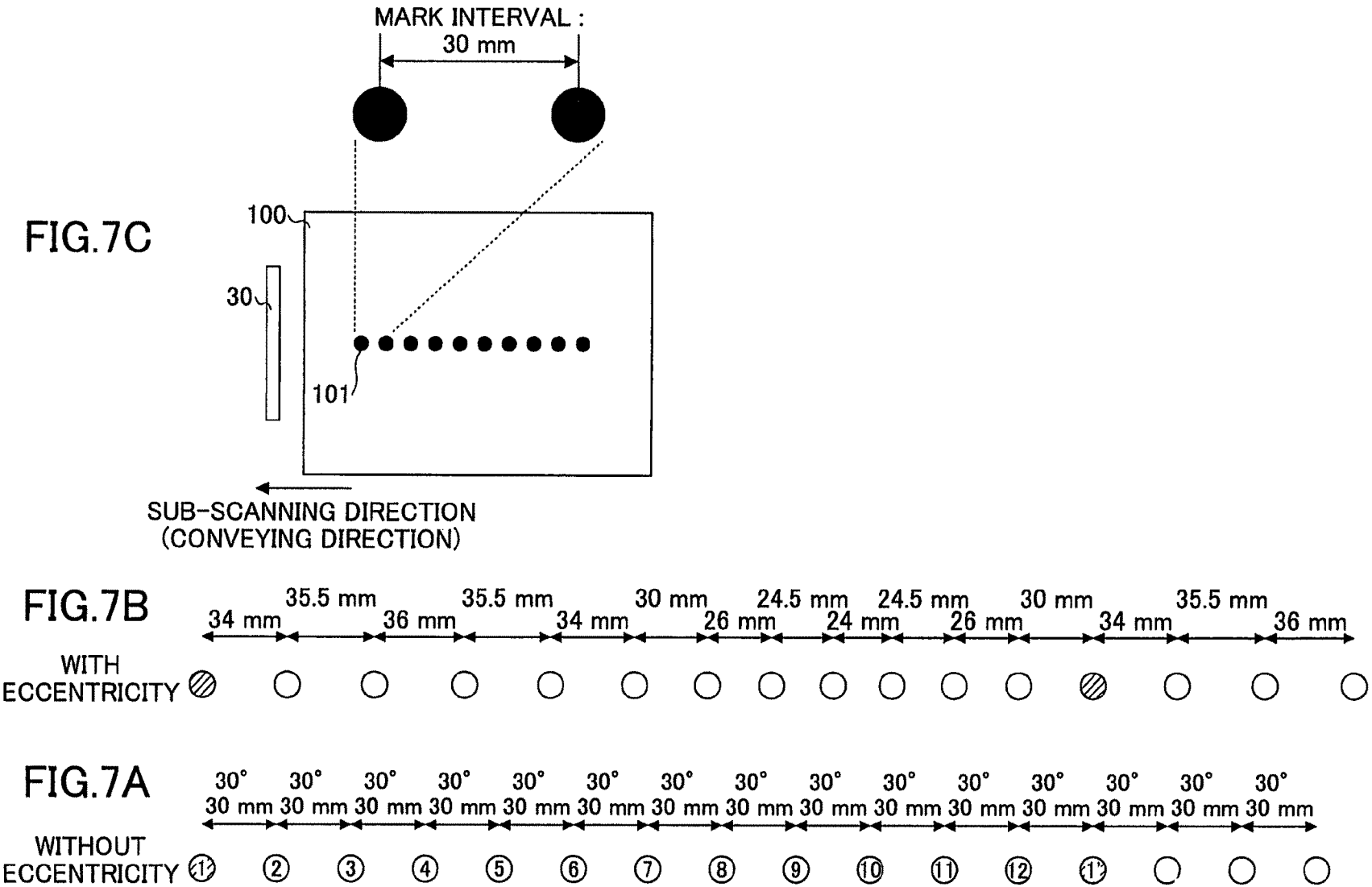
Figure 8:
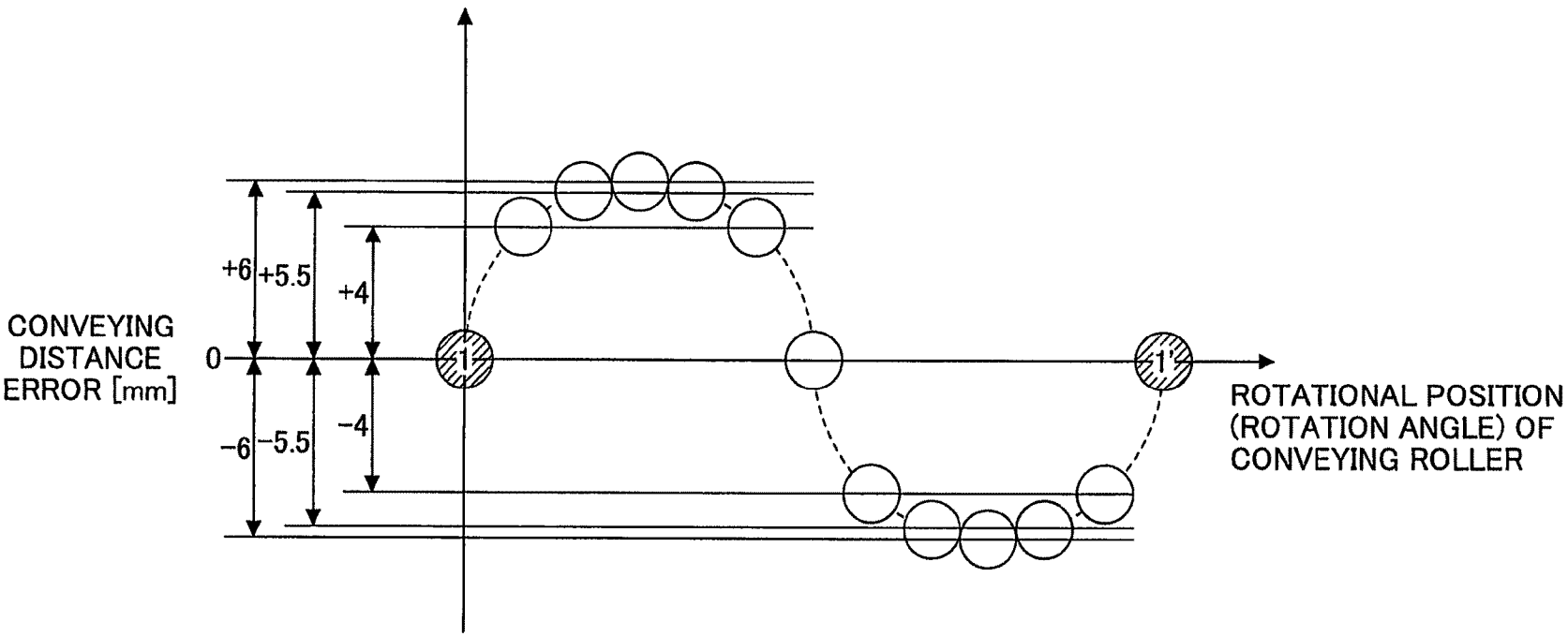
FIG. 8 is another drawing used to describe a case where the test chart 100 is not skewed.

A case where the test chart 100 is not skewed is described below with reference to FIGS. 7 and 8. FIGS. 7 and 8 show positions (positional information) of the marks 101 detected by the line sensor 30 when the test chart 100 is not skewed. In FIGS. 7 and 8, it is assumed that the distance (mark interval L) between the marks 101 arranged on the test chart 100 is 30 mm.

If the conveying roller 15 is in ideal conditions (e.g., the conveying roller 15 is accurately fixed and has a perfect circular shape, and there is no variation in the conveying distance of the conveying roller 15) and the test chart 100 is not skewed when it is conveyed by the conveying roller 15, the mark interval L between the positions of the marks 101 detected by the line sensor 30 becomes constant (L=30 mm) as shown in FIG. 7A (without eccentricity). FIG. 7A (without eccentricity) shows a theoretical conveying distance of the marks 101 (the ideal conveying distance of the conveying roller 15). The theoretical conveying distance of the marks 101 is stored in advance in a memory of the recording apparatus for reference.

If the conveying roller 15 is not in ideal conditions (e.g., the conveying roller 15 is not accurately fixed and does not have a perfect circular shape, and there is variation in the conveying distance of the conveying roller 15) and the test chart 100 is not skewed when it is conveyed by the conveying roller 15, the mark interval L between the positions of the marks 101 detected by the line sensor 30 varies (L=24-36 mm) as shown in FIG. 7B (with eccentricity). FIG. 7B (with eccentricity) shows actual conveying distances of the marks 101 including eccentric errors (actual conveying distances of the conveying roller 15 including eccentric errors). The actual conveying distances are calculated based on information obtained by detecting the marks 101 with the line sensor 30.

When the actual conveying distances of the marks 101 including the eccentric errors vary depending on rotational positions (rotation angles) of the conveying roller 15, the differences (conveying distance errors) between the actual conveying distances shown in FIG. 7B and the theoretical conveying distance shown in FIG. 7A are obtained in association with the rotational positions (rotation angles) of the conveying roller 15. Then, the relationships between the rotational positions (rotation angles) of the conveying roller 15 and the obtained differences (conveying distance errors) are approximated by a sine wave as shown in FIG. 8. Based on the relationships shown in FIG. 8, correction values for correcting the conveying distance of the conveying roller 15 are calculated for respective rotational positions (rotation angles) of the conveying roller 15, and the conveying distance of the conveying roller 15 is controlled based on the calculated correction values.

(When Test Chart 100 is Skewed)

A case where the test chart 100 is skewed is described below with reference to FIGS. 9 and 10.

The test chart 100 may be skewed when it is placed on a paper-feeding unit (not shown). FIGS. 9 and 10 show positions (positional information) of the marks 101 detected by the line sensor 30 when the test chart 100 is skewed.

Figure 9B:
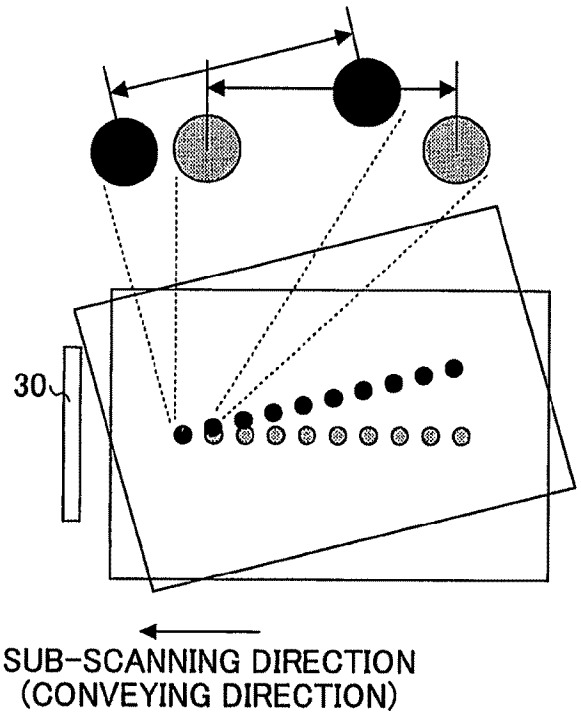
FIGS. 9A and 9B are drawings used to describe a case where the test chart 100 is skewed.
Figure 9A:
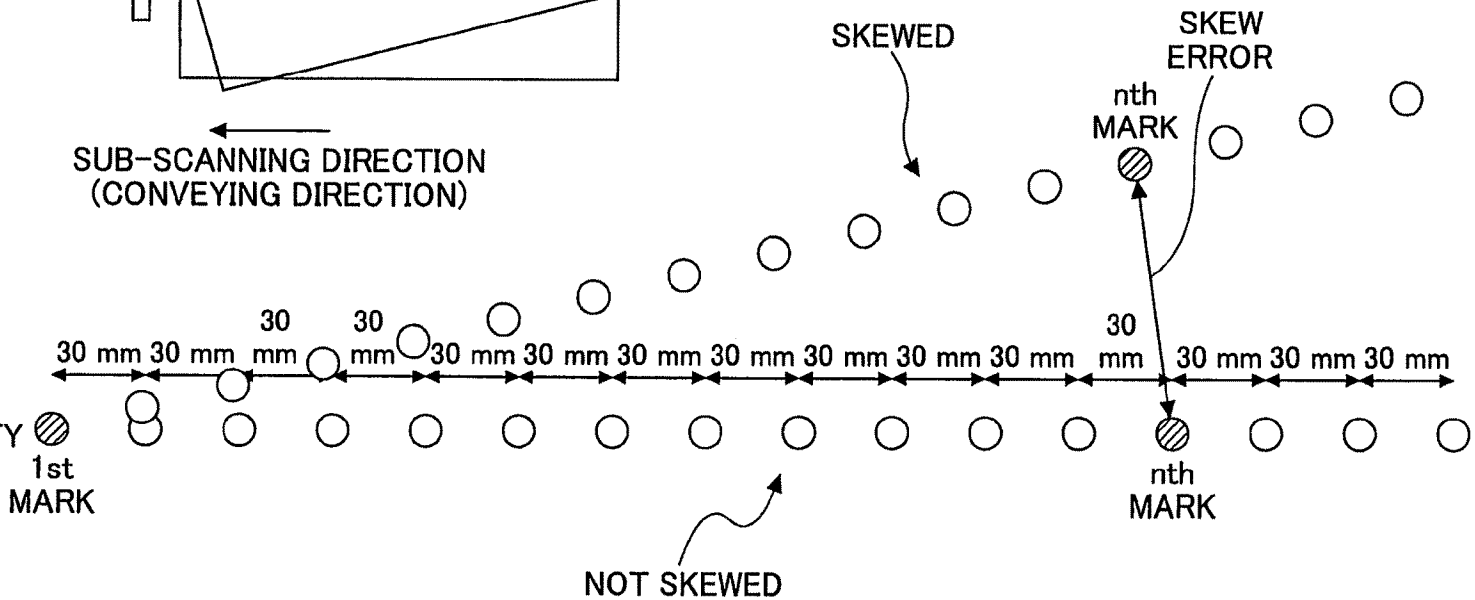

FIG. 9 shows positions of the marks 101 detected by the line sensor 30 when the conveying roller 15 is in ideal conditions and the test chart 100 is skewed. FIG. 10 shows positions of the marks 101 detected by the line sensor 30 when the conveying roller 15 is not in ideal conditions and the test chart 100 is skewed.

Figure 10B:
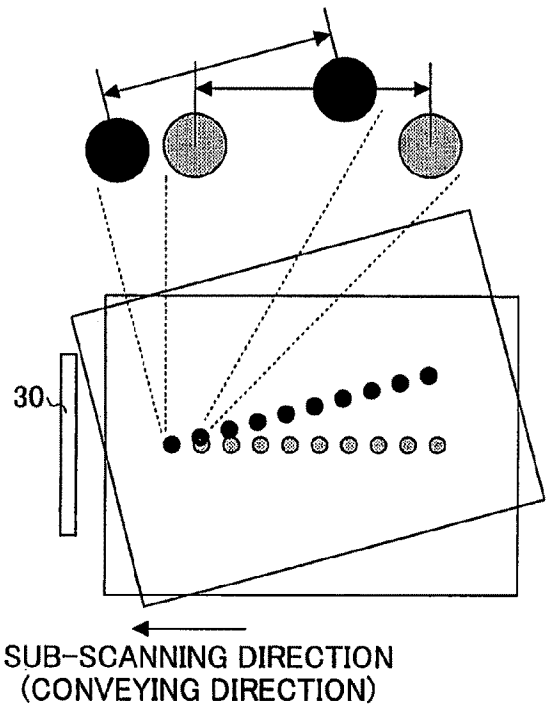
FIGS. 10A and 10B are other drawings used to describe a case where the test chart 100 is skewed.

As shown in FIGS. 9 and 10, when the test chart 100 is skewed, positions of the marks 101 detected by the line sensor 30 include errors caused by the skew (hereafter called skew errors). With the positions of the marks 101 including the skew errors, it is not possible to accurately calculate correction values (conveying distance errors) for correcting the conveying distance of the conveying roller 15.

To prevent the above problem, in the recording apparatus of this embodiment, the skew errors are removed from the positional information of the marks 101 shown in FIG. 10A which includes both eccentric errors and the skew errors. As a result, positional information of the marks 101 that includes only the eccentric errors as shown in FIG. 7B is obtained. Next, differences (conveying distance errors) between the positions of the marks 101 including eccentric errors as shown in FIG. 7B and the positions of the marks 101 including neither eccentric errors nor skew errors as shown in FIG. 7A are obtained in association with the rotational positions (rotation angles) of the conveying roller 15. Then, the relationships between the rotational positions (rotation angles) of the conveying roller 15 and the obtained differences (conveying distance errors) are approximated by a sine wave as shown in FIG. 8. Based on the relationships between the obtained differences (conveying distance errors) and the rotational positions (rotation angles) of the conveying roller 15, a correction value(s) for correcting the conveying distance of the conveying roller 15 is calculated and the conveying distance of the conveying roller 15 is controlled based on the calculated correction value.

Control Mechanism of Recording Apparatus

An exemplary control mechanism of the recording apparatus of this embodiment is described below with reference to FIG. 11.

The control mechanism of the recording apparatus of this embodiment includes a controller 107, a primary storage unit 118, a secondary storage unit 119, the carriage 5, a main-scanning driver 109, the recording heads 6, a recording head driver 111, the encoder sensor 41, the line sensor 30, a paper conveying unit 112, the encoder sensor 34, a sub-scanning driver 113, and an image processing unit 120.

The controller 107 supplies recording data and drive control signals (pulse signals) to the primary storage unit 118 and the drivers 109, 111, and 113, and controls the entire recording apparatus. For example, the controller 107 controls the movement of the carriage 5 in the main-scanning direction via the main-scanning driver 109; controls timing of jetting ink from the recording heads 6 via the recording head driver 111; and controls operations of the paper conveying unit 112 (including the conveying roller 15 and the motor 32) in the sub-scanning direction via the sub-scanning driver 113.

The encoder sensor 41 obtains encoder values by detecting marks on the encoder sheet 40 and outputs the obtained encoder values to the controller 107. Based on the encoder values from the encoder sensor 41, the controller 107 controls the movement of the carriage 5 in the main-scanning direction via the main-scanning driver 109.

The encoder sensor 34 obtains encoder values by detecting the patterns A and B of the encoder wheel 33 and outputs the obtained encoder values to the controller 107. Based on the encoder values from the encoder sensor 34, the controller 107 controls operations of the paper conveying unit 112 in the sub-scanning direction via the sub-scanning driver 113.

The line sensor 30 obtains data by sequentially detecting the marks 101 arranged on the test chart 100 and outputs the obtained data to the controller 107. The controller 107 calculates positions of the marks 101 based on the output data from the line sensor 30, associates the positions of the marks 101 with the encoder values that are detected by the encoder sensor 34 when the marks 101 are detected by the line sensor 30, and stores the positions of the marks 101 associated with the encoder values in the primary storage unit 118.

The primary storage unit 118 stores information used by the controller 107 and is rewritable from the outside. For example, the primary storage unit 118 stores programs or procedures to be executed by the controller 107. The secondary storage unit 119 is used, for example, as a working memory.

In this embodiment, the controller 107 retrieves image information from the image processing unit 120 according to a print mode, temporarily stores the retrieved image information in the secondary storage unit 119, and converts the image information into an image format for the recording heads 6. Then, the controller 107 transfers the converted image information from the secondary storage unit 119 to the recording head driver 111. The recording head driver 111 generates timing signals for driving the recording heads 6 according to the print mode, and sends the timing signals and the image information to the recording heads 6 to perform a printing process.

During the printing process, the controller 107 also controls, according to the print mode, the movement of the carriage 5 in the main-scanning direction via the main-scanning driver 109, and controls operations of the paper conveying unit 112 (including the conveying roller 15 and the motor 32) in the sub-scanning direction via the sub-scanning driver 113.

Conveying Distance Control Method

A conveying distance control method of this embodiment is described below with reference to FIG. 12.

Figure 12:
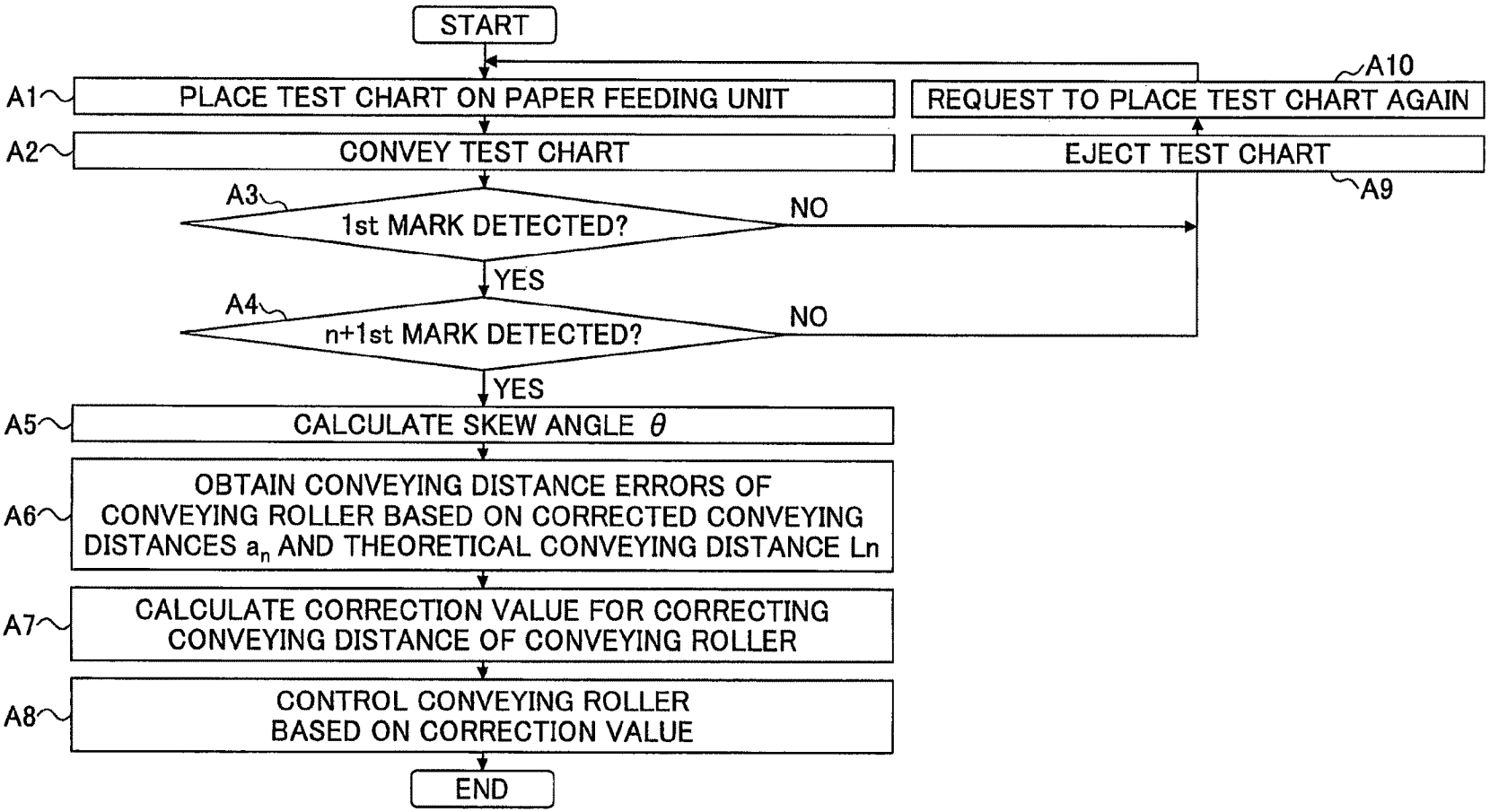
FIG. 12 is a flowchart showing a process performed by a recording apparatus.

As shown in FIG. 12, when the test chart 100 is placed on the paper feeding unit (not shown) (step A1), the controller 107 controls the operations of the paper conveying unit 112 (including the conveying roller 15 and the motor 32) to convey the test chart 100 in the sub-scanning direction (conveying direction) with the conveying roller 15 (step A2).

The line sensor 30 sequentially detects the marks 101 (from the 0th mark 101 to the n+1st mark 101) within one rotation of the conveying roller 15, and the controller 107 calculates positions of the marks 101 based on lines of data output from the line sensor 30 (steps A3 and A4).

For example, when lines of data as shown in FIG. 5B are output from the line sensor 30, the controller 107 calculates positions (x and y coordinates) of the marks 101 as shown in FIG. 5A.

Here, if the skew (skew angle θ) of the test chart 100 is large and the marks 101 are out of the detection range of the line sensor 30, the line sensor 30 is not able to detect the marks 101. Therefore, if the 1st mark 101 or the n+1st mark 101 (which is to be detected when the conveying roller 15 is rotated once) has not been detected by the line sensor 30 (NO in step A3 or A4), the controller 107 ejects the test chart 100 from a paper ejecting unit (not shown) (step A9) and requests the user to place the test chart 100 again on the paper feeding unit (step A10). For example, the controller 107 requests the user to place the test chart 100 again on the paper feeding unit via a voice or text message.

Figure 13:
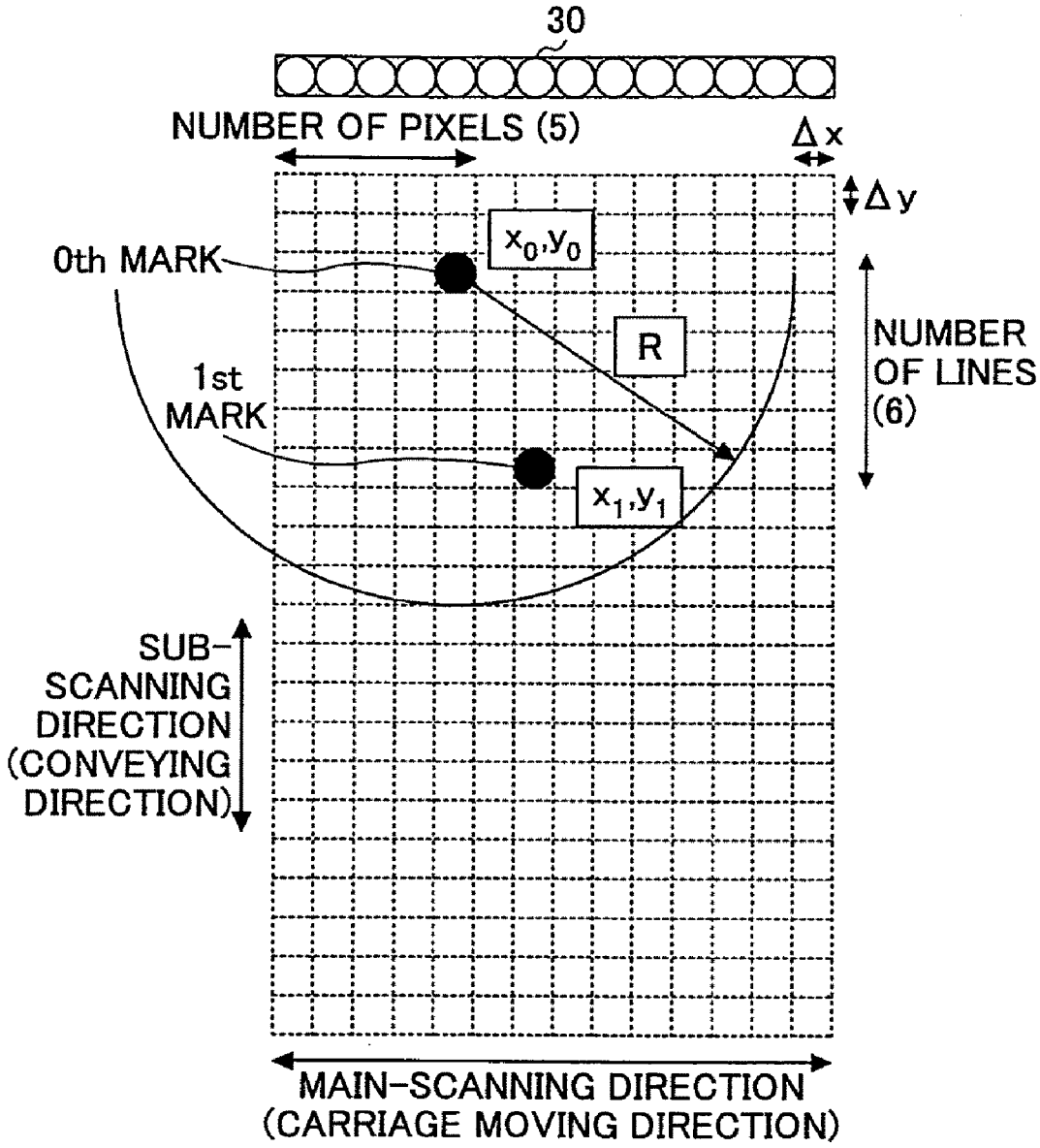
FIG. 13 is a drawing used to describe a criterion for determining whether a 1st mark 101 has been detected.

As shown in FIG. 13, the 1st mark 101 is expected to be within a distance R from the 0th mark 101. Therefore, the controller 107 determines that the 1st mark 101 has not been detected by the line sensor 30 if no mark 101 is detected within the distance R from the position $(x_0, y_0)$ of the 0th mark 101. The distance R is predetermined and stored, for example, in the primary storage unit 118 for reference by the controller 107.

If the n+1st mark 101 (which is to be detected when the conveying roller 15 is rotated once) has been detected by the line sensor 30 (YES in step A4), the controller 107 calculates the skew angle θ of the test chart 100 (step A5).

Figure 14:
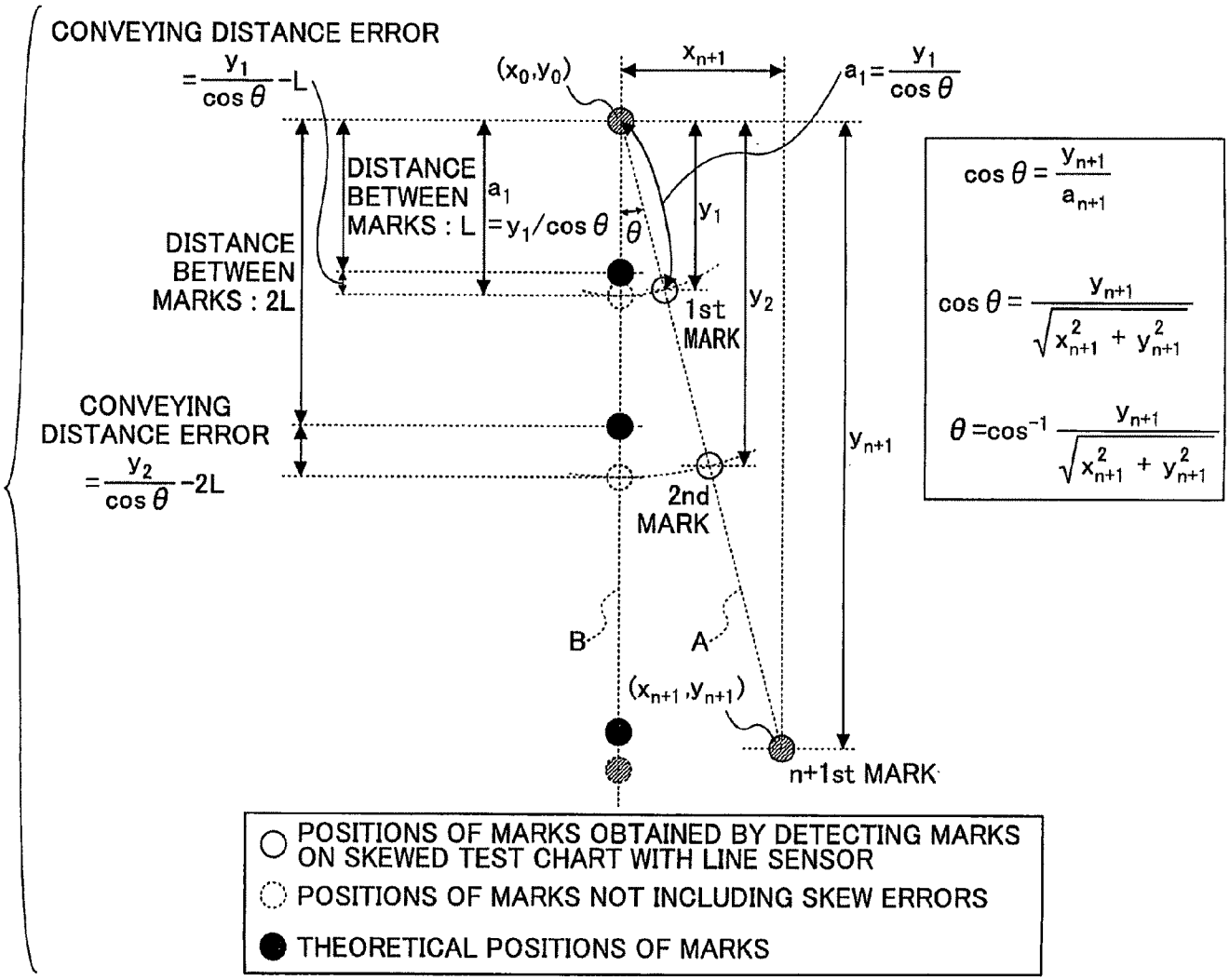
FIG. 14 is a drawing illustrating an exemplary method of calculating a skew angle θ.

As shown in FIG. 14, the skew angle θ indicates the angle between a line A passing through the positions of two marks 101 ($(x_0, y_0)$ and $(x_{n+1}, y_{n+1})$) and a conveying direction B of the conveying roller 15. The skew angle θ is obtained using formula 1 shown below based on the position $(x_{n+1}, y_{n+1})$ of the n+1st mark 101 that is detected when the conveying roller 15 is rotated once.

$$\theta = \cos^{-1}\frac{y_{n+1}}{\sqrt{x_{n+1}^2 + y_{n+1}^2}} = \sin^{-1}\frac{x_{n+1}}{\sqrt{x_{n+1}^2 + y_{n+1}^2}} \quad \text{[Formula 1]}$$

The coordinate $X_{n+1}$ of the n+1st mark 101 is represented by the difference from the coordinate $x_0$ of the 0th mark 101. Similarly, the coordinate $y_{n+1}$ of the n+1st mark 101 is represented by the difference from the coordinate $y_0$ of the 0th mark 101.

Next, the controller 107 obtains, for each mark 101, a conveying distance error ye_n of the conveying roller 15 by using formula 2 shown below based on a corrected conveying distance $a_n$ (a conveying distance of the conveying roller 15 including only an eccentric error) and a theoretical conveying distance Ln of the mark 101 (the theoretical conveying distance of the conveying roller 15) (step A6). The corrected conveying distance $a_n$ is obtained by removing the influence (a skew error) caused by the skew angle θ from an actual conveying distance of the mark 101 (an actual conveying distance of the conveying roller 15 including an eccentric error and askew error) detected by the line sensor 30.

Conveying distance error ye_n of conveying roller for *nth* mark [Formula 2]

$$\text{ye_n} = \frac{y_n}{\cos\theta} - nL$$

In formula 2, L indicates the mark interval, and $y_n/\cos\theta$ corresponds to the corrected conveying distance $a_n$.

Figure 15:
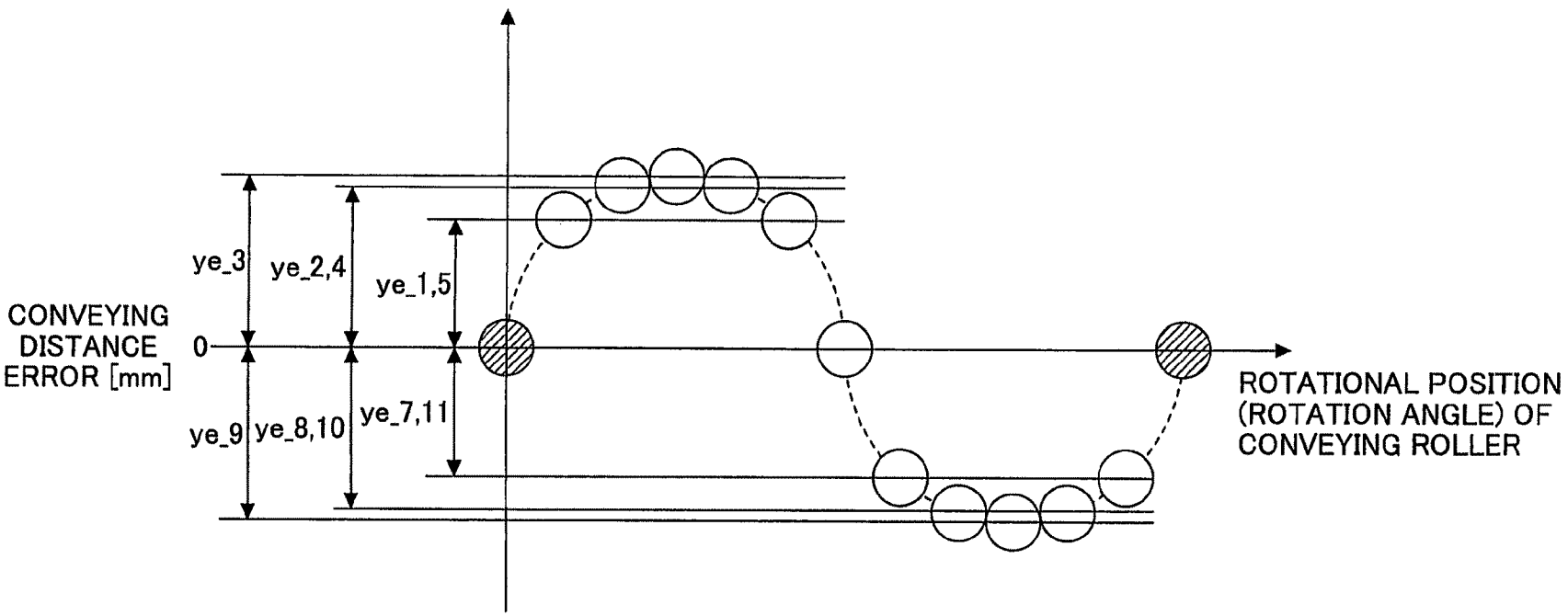
FIG. 15 is a drawing showing relationships between rotational positions (rotation angles) of a conveying roller 15 and differences (conveying distance errors) ye_n.

When the actual conveying distances of the marks 101 vary according to rotational positions (rotation angles) of the conveying roller 15, the differences (conveying distance errors) ye_n between the corrected conveying distances $a_n$ and the theoretical conveying distance Ln of the marks 101 are obtained in association with the rotational positions (rotation angles) of the conveying roller 15. Then, the relationships between the rotational positions (rotation angles) of the conveying roller 15 and the obtained differences (conveying distance errors) ye_n are approximated by a sine wave as shown in FIG. 15. Based on the relationships between the obtained differences (conveying distance errors) ye_n and the rotational positions (rotation angles) of the conveying roller 15, a correction value(s) for correcting the conveying distance of the conveying roller 15 is calculated (step A7) and the conveying distance of the conveying roller 15 is controlled based on the calculated correction value (step A8). The above process makes it possible to reduce the variation in the sub-scanning-direction conveying distance of the conveying roller 15.

An exemplary calculation of a correction value is described with reference to FIG. 16. In the exemplary calculation, it is assumed that the current rotational position of the conveying roller 15 is (3) and the conveying roller 15 is to be rotated to a target rotational position (8).

The conveying distance error at the current rotational position (3) is "A $\sin(\theta-\phi)=6\ \sin(60°-0°)=6\times\sin 60°=6\times0.866=5.196$ [mm]".

Meanwhile, the conveying distance error at the target rotational position (8) is "A $\sin(\theta-\phi)=6\ \sin(210°-0°)=6\times\sin 210°=6\times-0.5=-3.0$ [mm]".

In this case, the correction value is "conveying distance error at target rotational position−conveying distance error at current rotational position=−3.0−(+5.196)=−8.196[=]".

Therefore, the conveying distance of the conveying roller 15 corrected by the correction value is "conveying distance of conveying roller without eccentricity−correction value=150−(−8.196)=158.196 [mm]".

The controller 107 controls the rotational position (rotation angle) of the conveying roller 15 so that the actual conveying distance of the conveying roller 15 becomes 158.196 mm.

Figure 16:
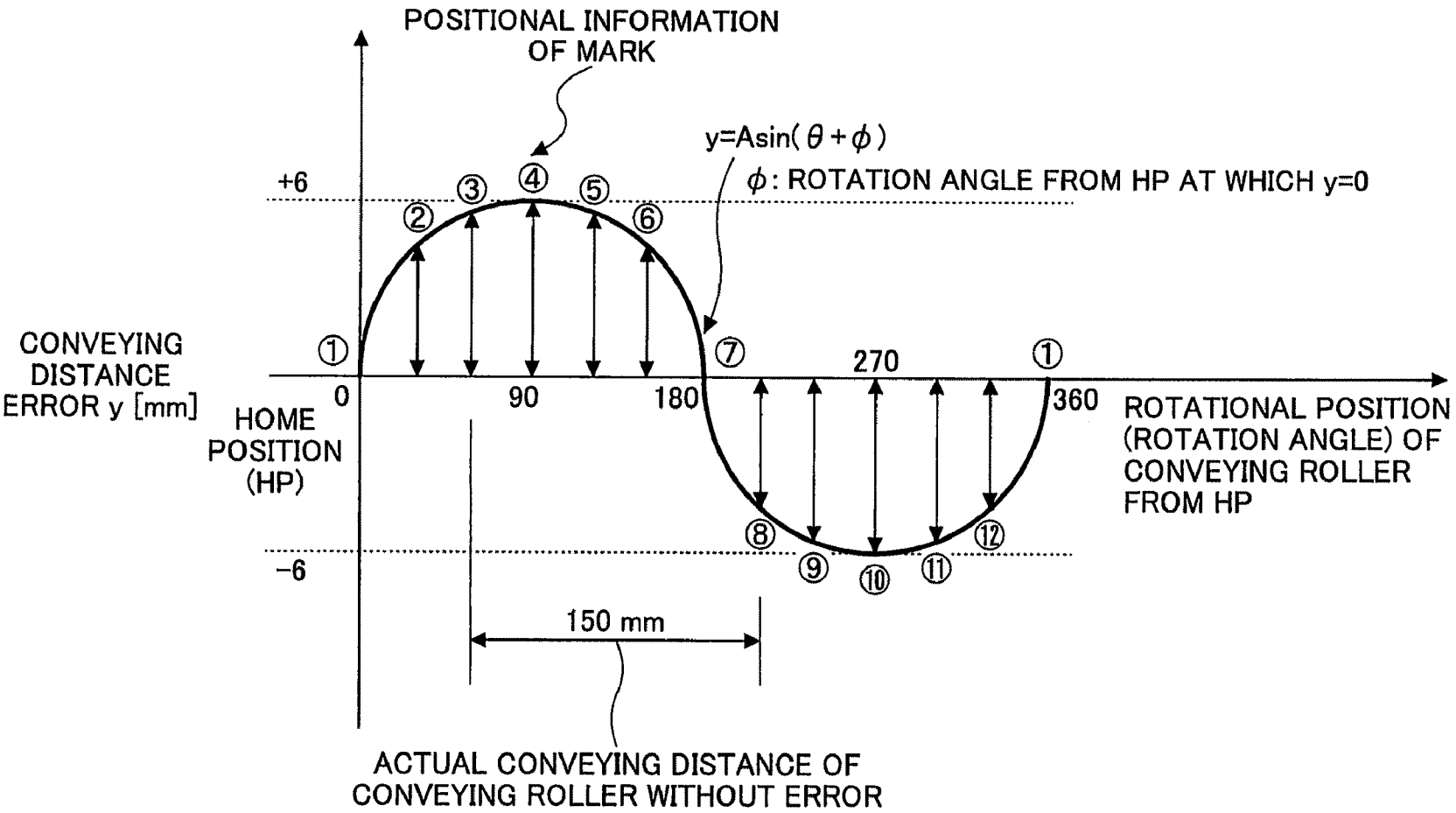
FIG. 16 is drawing used to describe a method of adjusting the conveying distance of the conveying roller 15.

In the relational expression shown in FIG. 16, a point where the conveying distance error is 0 mm corresponds to the rotation angle 0° of the conveying roller 15 from the home position. However, the point where the conveying distance error is 0 mm does not always correspond to the rotation angle 0° of the conveying roller 15 from the home position. Therefore, the relationship between the conveying distance error and the rotation angle of the conveying roller 15 from the home position is represented by $y=A\ \sin(\theta+\phi)$. In this formula, $\phi$ indicates a rotation angle of the conveying roller 15 from the home position (HP) at which the conveying distance error becomes 0 mm.

As described above, in the recording apparatus of this embodiment, the conveying roller 15 is rotated and the marks 101 arranged on the test chart 100 shown in FIG. 2 are sequentially detected by the line sensor 30. The controller 107 removes errors (skew errors) caused by the skew from the positional information of the marks 101 shown in FIG. 10A which includes both eccentric errors and the skew errors to obtain positional information of the marks 101 that includes only the eccentric errors as shown in FIG. 7B. Next, the controller 107 obtains differences (conveying distance errors) between the positions of the marks 101 including eccentric errors as shown in FIG. 7B and the positions of the marks 101 including neither eccentric errors nor skew errors as shown in FIG. 7A in association with the rotational positions (rotation angles) of the conveying roller 15. Then, the controller 107 approximates the relationships between the rotational positions (rotation angles) of the conveying roller 15 and the obtained differences (conveying distance errors) by a sine wave as shown in FIG. 8. The controller 107 calculates a correction value(s) for correcting the conveying distance of the conveying roller 15 based on the relationships between the obtained differences (conveying distance errors) and the rotational positions (rotation angles) of the conveying roller 15, and controls the conveying roller 15 based on the calculated correction value.

Thus, the recording apparatus of this embodiment makes it possible to reduce the variation in the conveying distance in the sub-scanning direction of the conveying roller 15 by using the test chart 100 and thereby makes it possible to keep constant the conveying distance per unit time of the conveying roller 15.

In the above embodiment, a correction value(s) for correcting the conveying distance of the conveying roller 15 is calculated based on the variation in the conveying distance during one rotation of the conveying roller 15. Alternatively, a correction value(s) may be obtained based on an average of variations in the conveying distance during two or more rotations of the conveying roller 15.

Second Embodiment

Next, a second embodiment of the present invention is described.

In the first embodiment, as shown in FIG. 3, it is assumed that the distance $\alpha$ between the line sensor 30 and the conveying roller 15 is constant.

However, there is a case where the distance $\alpha$ between the line sensor 30 and the conveying roller 15 is not constant due to, for example, an assembly error of the line sensor 30.

Figure 17:
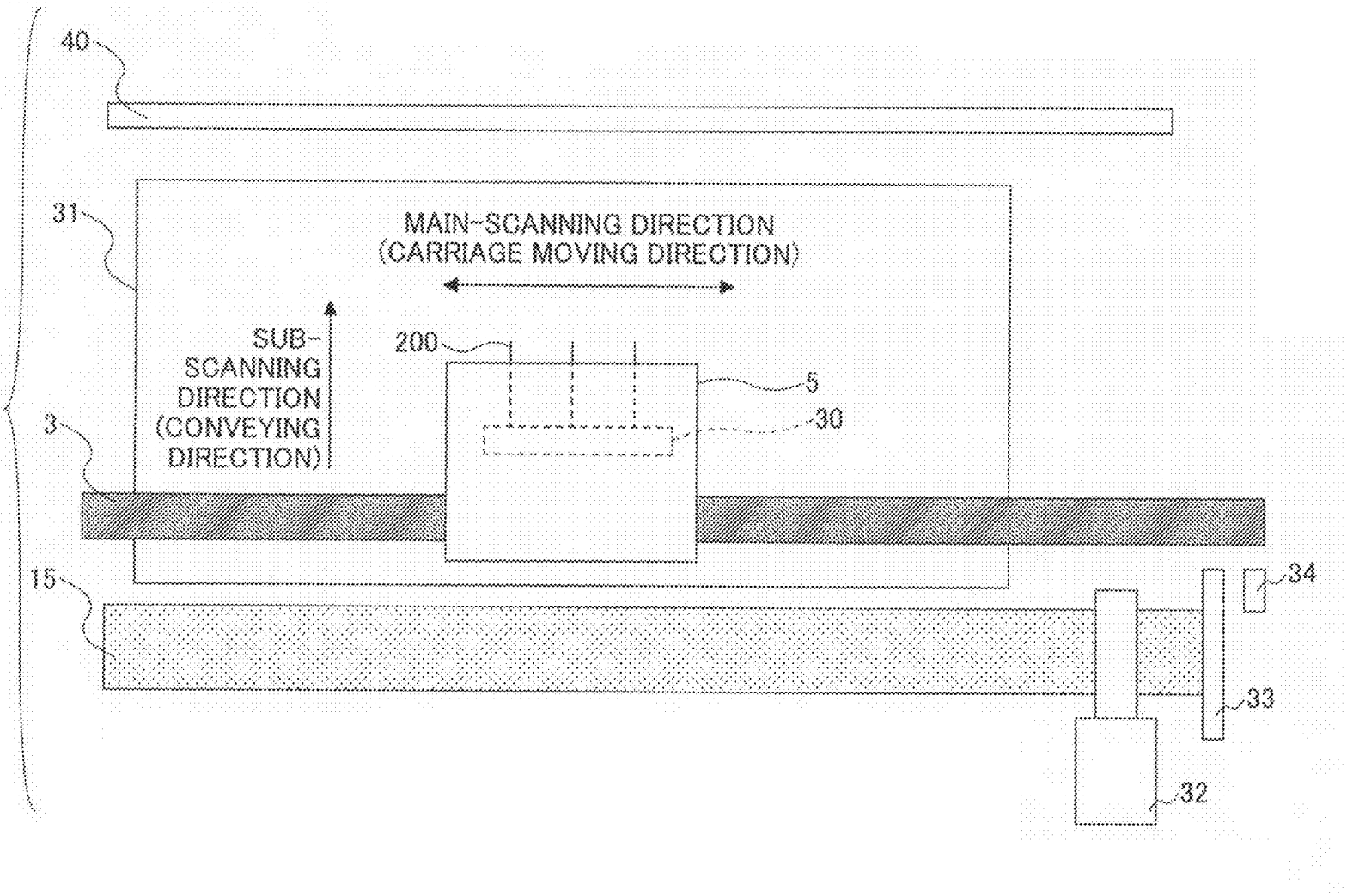
FIG. 17 is a drawing illustrating a platen 31 of a second embodiment of the present invention.

In this embodiment, to cope with this problem, adjustment marks 200 arranged in the main-scanning direction are formed on the platen 31 as shown in FIG. 17. Positions of the adjustment marks 200 are measured by detecting the adjustment marks 200 with the line sensor 30, and correction values are calculated such that the positional measurements of the adjustment marks 200 in the sub-scanning direction fall on the same line in the main-scanning direction if they are corrected by the correction values. Then, positions (positional information) in the sub-scanning direction of the marks 101 detected by the line sensor 30 are corrected based on the correction values.

This configuration makes it possible to correct positions (positional information) in the sub-scanning direction of the marks 101 detected by the line sensor 30 based on the correction values, and thereby makes it possible to reduce the variation in the sub-scanning-direction conveying distance of the conveying roller 15 as in the first embodiment even when the distance $\alpha$ between the line sensor 30 and the conveying roller 15 is not constant. A recording apparatus of the second embodiment is described below.

According to the second embodiment, as shown in FIG. 17, the adjustment marks 200 arranged in the main-scanning direction are formed on the platen 31. The adjustment marks 200 are used to determine whether the distance $\alpha$ between the line sensor 30 and the conveying roller 15 is constant. In the example shown in FIG. 17, three adjustment marks 200 are arranged in the main-scanning direction.

The line, sensor 30 detects the adjustment marks 200 on the platen 31, and the controller 107 measures positions of the adjustment marks 200 based on the detection results. Then, the controller 107 determines whether the distance $\alpha$ between the line sensor 30 and the conveying roller 15 is constant based on the positional measurements of the adjustment marks 200.

Figure 18B:
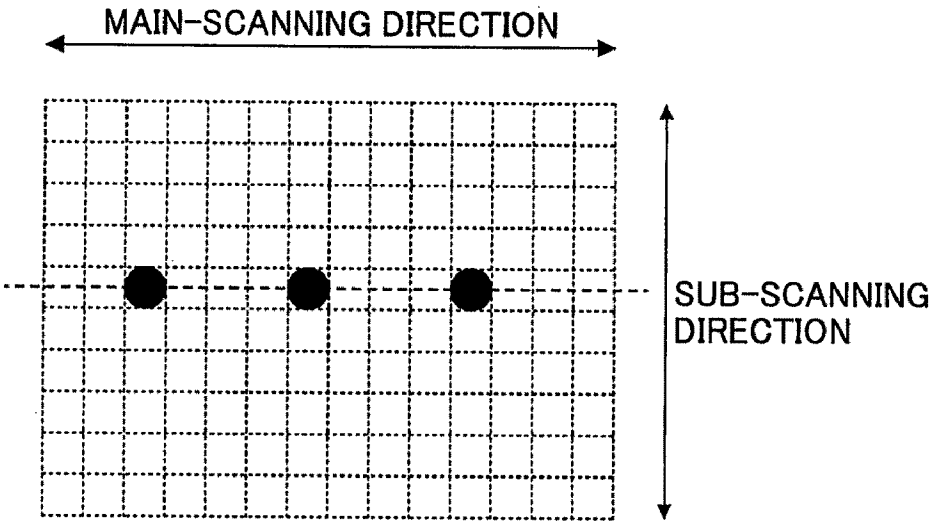
FIGS. 18A and 18B are drawings (1) used to describe an exemplary method of correcting positional information in the sub-scanning direction of the marks 101.
Figure 18A:
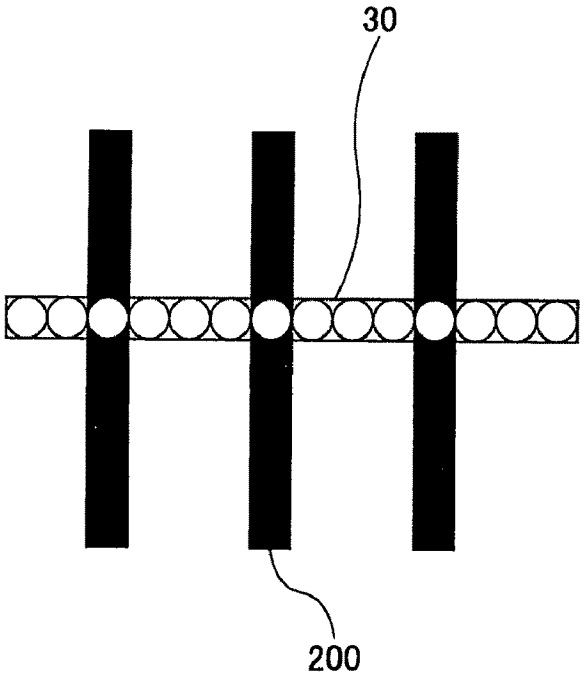

When the distance α between the line sensor 30 and the conveying roller 15 is constant, the positional measurements of the adjustment marks 200 detected by the line sensor 30 are on the same line in the main-scanning direction as shown in FIG. 18B. FIG. 18A shows positional relationships between the adjustment marks 200 and the line sensor 30 when the distance α between the line sensor 30 and the conveying roller 15 is constant. FIG. 18B shows positional measurements of the adjustment marks 200 detected by the line sensor 30 corresponding to the positional relationships shown in FIG. 18A.

Figure 19A:
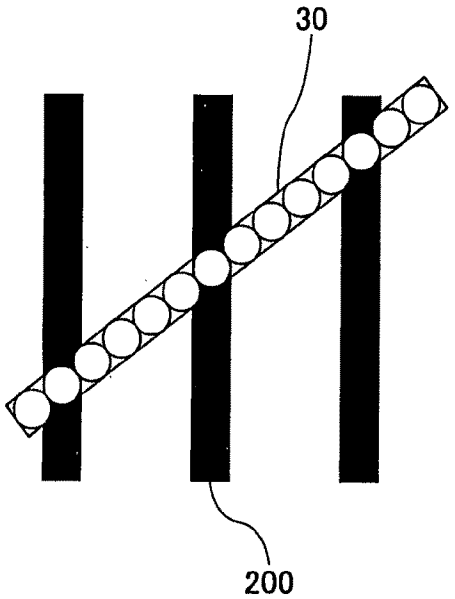
FIGS. 19A through 19C are drawings (2) used to describe an exemplary method of correcting positional information in the sub-scanning direction of the marks 101.
Figure 19B:
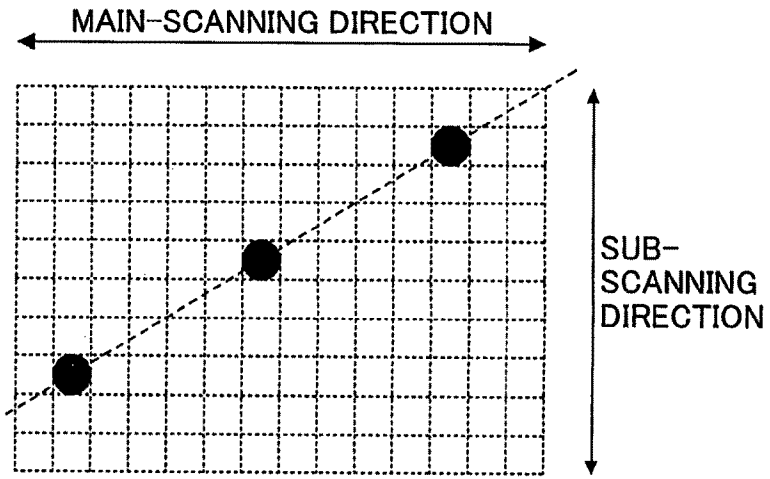

When the distance α between the line sensor 30 and the conveying roller 15 is not constant, the positions of the adjustment marks 200 detected by the line sensor 30 are not on the same line in the main-scanning direction, i.e., their positions in the sub-scanning direction vary as shown in FIG. 19B. FIG. 19A shows positional relationships between the adjustment marks 200 and the line sensor 30 when the distance α between the line sensor 30 and the conveying roller 15 is not constant. FIG. 19B shows positional measurements of the adjustment marks 200 detected by the line sensor 30 corresponding to the positional relationships shown in FIG. 19A.

Figure 19C:
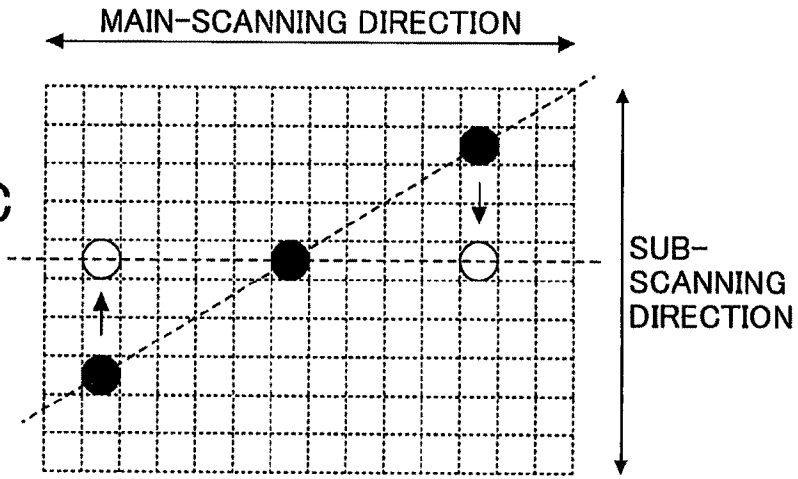

In this embodiment, the controller 107 determines that the distance α between the line sensor 30 and the conveying roller 15 is not constant if the positional measurements of the adjustment marks 200 are as shown in FIG. 19B. In this case, the controller 107 corrects the positional measurements of the adjustment marks 200 shown in FIG. 19B such that the positional measurements of the adjustment marks 200 in the sub-scanning direction fall on the same line in the main-scanning direction as shown in FIG. 19C. Any known method may be used to correct the positional measurements of the adjustment marks 200 as long as the corrected positional measurements of the adjustment marks 200 in the sub-scanning direction fall on the same line in the main-scanning direction.

Figure 20A:
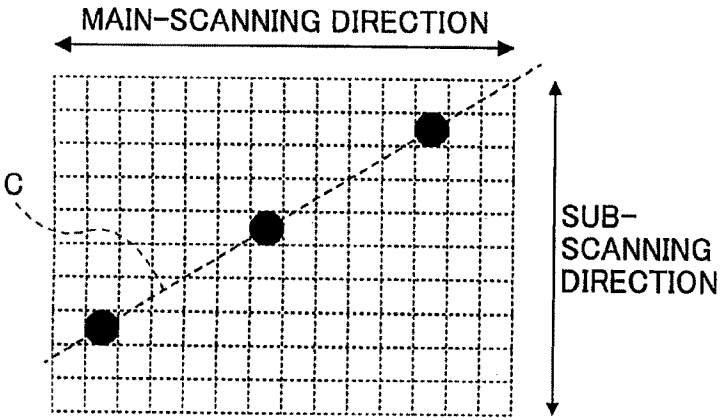
FIGS. 20A through 20D are drawings (3) used to describe an exemplary method of correcting positional information in the sub-scanning direction of the marks 101.
Figure 20B:
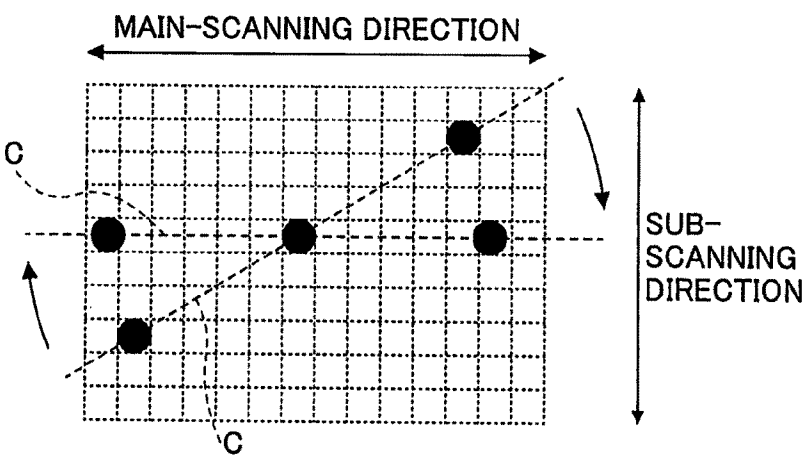
Figure 20C:
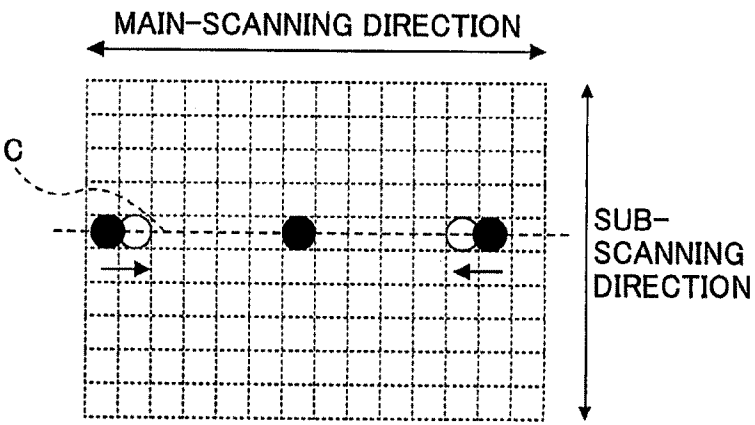
Figure 20D:
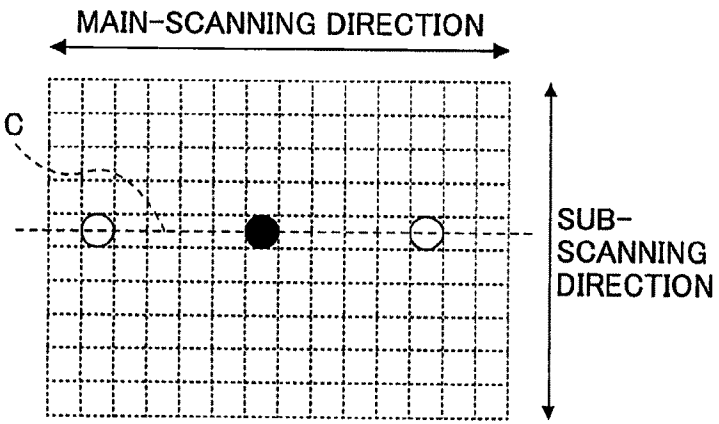

For example, assuming a line C passing through the positional measurements of the adjustment marks 200 as shown in FIG. 20A, the positional measurements of the adjustment marks 200 are moved by rotating the line C as shown in FIG. 20B so that the positional measurements of the adjustment marks 200 in the sub-scanning direction fall on the same line in the main-scanning direction. Then, as shown in FIG. 20C, the pixel positions of the adjustment marks 200 in the main-scanning direction after the rotation are adjusted so as to match the original pixel positions in the main-scanning direction before the rotation. More specifically, the pixel numbers of the adjustment marks 200 after the rotation are adjusted so as to match the pixel numbers of the scanning pixels of the line sensor 30 detecting the adjustment marks 200. As a result, as shown in FIG. 20D, the positional measurements of the adjustment marks 200 are corrected so as to fall on the same line in the main-scanning direction. The controller 107 calculates correction values for correcting the positional measurements of the adjustment marks 200 such that the corrected positional measurements of the adjustment marks 200 in the sub-scanning direction fall on the same line in the main-scanning direction as shown in FIG. 19C or 20D. The obtained correction values are in turn used to correct the positional information in the sub-scanning direction of the marks 101 detected by the line sensor 30.

Conveying Distance Control Method

Figure 21:
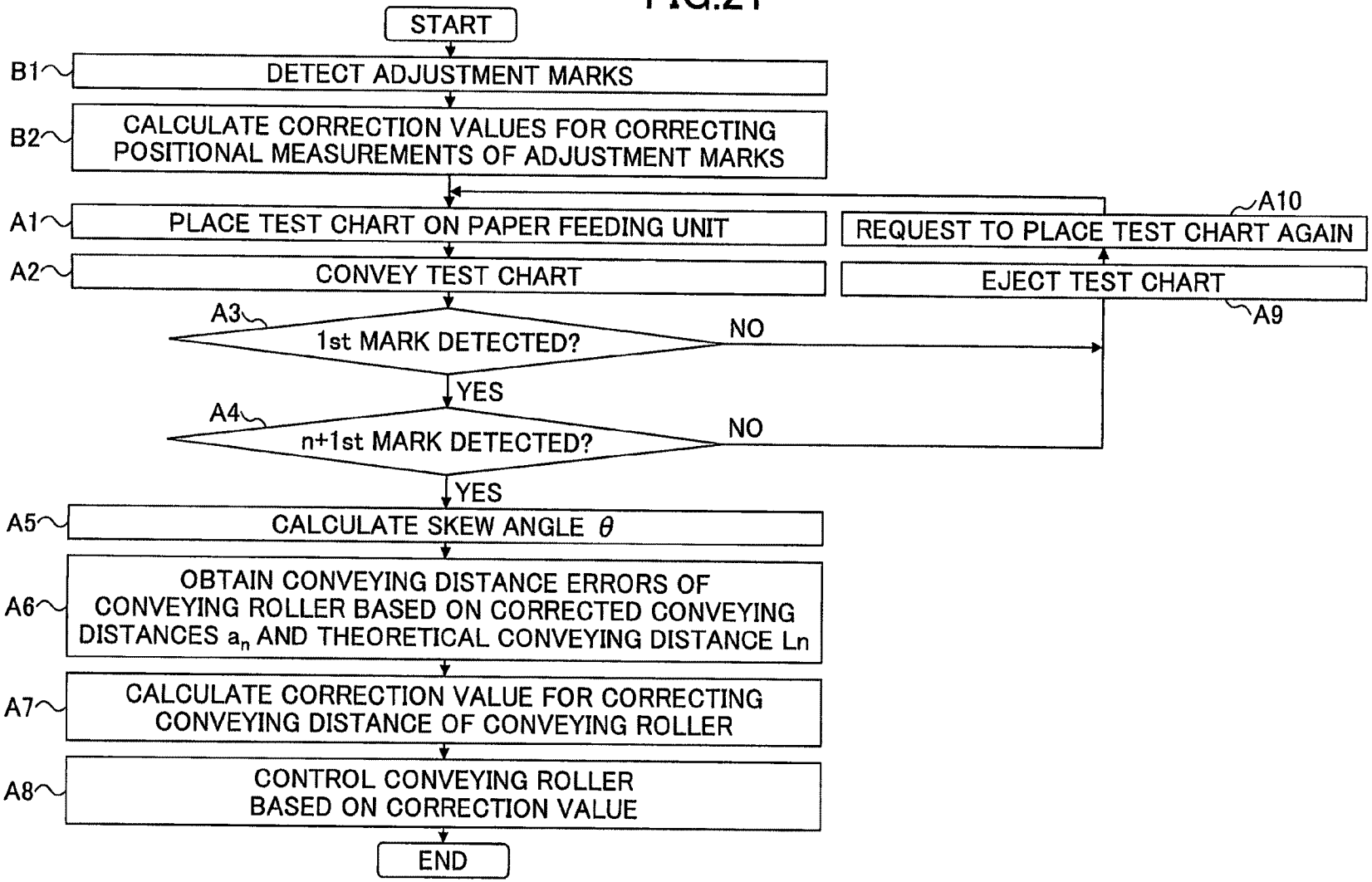
FIG. 21 is a flowchart showing a process performed by a recording apparatus according to the second embodiment.

A conveying distance control method of this embodiment is described below with reference to FIG. 21.

The line sensor 30 detects the adjustment marks 200 arranged in the main-scanning direction on the platen 31 (step B1).

The controller 107 determines whether the distance α between the line sensor 30 and the conveying roller 15 is constant based on the positional measurements of the adjustment marks 200 detected by the line sensor 30. Next, the controller 107 calculates correction values for correcting the positional measurements of the adjustment marks 200 detected by the line sensor 30 such that the positional measurements of the adjustment marks 200 in the sub-scanning direction fall on the same line in the main-scanning direction (step B2). Then, the controller 107 corrects the positional information in the sub-scanning direction of the marks 101 detected by the line sensor 30 based on the correction values calculated in step B2. The remaining steps are performed based on the corrected positional information of the marks 101 in substantially the same manner as in the first embodiment.

In this embodiment, as described above, positional measurements of the adjustment marks 200 are obtained by detecting the adjustment marks 200 with the line sensor 30, and correction values are calculated such that the positional measurements of the adjustment marks 200 in the sub-scanning direction fall on the same line in the main-scanning direction if they are corrected by the correction values. Then, positional information in the sub-scanning direction of the marks 101 detected by the line sensor 30 are corrected based on the correction values.

This configuration makes it possible to correct positional information in the sub-scanning direction of the marks 101 detected by the line sensor 30 based on the correction values, and thereby makes it possible to reduce the variation in the sub-scanning-direction conveying distance of the conveying roller 15 as in the first embodiment even when the distance α between the line sensor 30 and the conveying roller 15 is not constant.

Third Embodiment

Next, a third embodiment of the present invention is described.

In the first embodiment, the position (y-coordinate) in the sub-scanning direction of the mark 101 is calculated by multiplying the pixel size by the number of lines scanned by the line sensor 30 until the mark 101 is detected (pixel size X number of lines). Alternatively, the position (y-coordinate) of a mark 101 in the sub-scanning direction may be calculated based on encoder values that are detected by the encoder sensor 34 when the mark 101 and a previous mark 101 are detected by the line sensor 30.

For example, the controller 107 calculates a difference between an encoder value obtained from the encoder sensor 34 when the 0th mark 101 is detected by the line sensor 30 and an encoder value obtained from the encoder sensor 34 when the 1st mark 101 is detected by the line sensor 30, and calculates the position ($y_1$) of the 1st mark 101 in the sub-scanning direction based on a conveying distance of the conveying roller 15 corresponding to the calculated difference. This configuration makes it possible to reduce the variation in the sub-scanning-direction conveying distance of the conveying roller 15 as in the first embodiment.

The present invention is not limited to the specifically disclosed embodiments, and variations and modifications may be made without departing from the scope of the present invention.

Components and functions of the recording apparatus described in the above embodiments may be implemented by hardware, software, or a combination of them.

For example, processes described above may be performed by executing a program installed in a memory of a general-purpose computer or a computer embedded in dedicated hardware.

The program may be stored in advance in a storage medium such as a hard disk or a read only memory (ROM). Alternatively, the program may be temporarily or permanently stored in a removable storage medium. The program stored in a removable storage medium may be provided as packaged software. Examples of removable storage media include a floppy disk, a CD-ROM, a magneto optical (MO) disk, a digital versatile disk (DVD), a magnetic disk, and a semiconductor memory.

The program may be installed from a removable recording medium, wirelessly downloaded from a download site, or downloaded via a wired network.

Steps in the processes described in the above embodiments may be performed sequentially, in parallel, or individually according to the performance of an apparatus performing the processes or as needed.

In the above embodiments, the variation in the conveying distance of the conveying roller 15 in the sub-scanning direction is reduced to prevent misalignment of dots formed on the recording medium 16. However, the disclosure of the present application may also be applied to a mechanism such as a finisher.

In the above embodiments, a recording apparatus is used as an example. However, the disclosure of the present application may also be applied to a conveying distance control device for controlling the conveying distance of any medium (e.g., a laminate material or a card material) other than the recording medium 16.

The present application is based on Japanese Priority Application No. 2009-212306, filed on Sep. 14, 2009, the entire contents of which are hereby incorporated herein by reference.

What is claimed is:

1. A conveying distance control device, comprising:

a conveying roller conveying a recording medium;

a first detecting unit detecting rotational positions of the conveying roller;

a line sensor sequentially detecting marks arranged on a test chart being conveyed by the conveying roller;

a calculation unit calculating a skew angle between a line passing through positions of a first mark and a second mark of the marks and a conveying direction of the conveying roller based on positional information of the marks detected by the line sensor; and a control unit obtaining corrected conveying distances by removing errors caused by the skew angle from actual conveying distances of the marks detected by the line sensor, obtaining conveying distance errors indicating differences between the corrected conveying distances and a theoretical conveying distance of the marks in association with the rotational positions of the conveying roller, calculating a correction value for correcting a conveying distance of the conveying roller based on relationships between the conveying distance errors and the rotational positions of the conveying roller, and controlling the conveying distance of the conveying roller based on the calculated correction value.

2. The conveying distance control device as claimed in claim 1, wherein the positional information of each of the marks includes first positional information indicating a position in a direction orthogonal to the conveying direction of the conveying roller and second positional information indicating a position in the conveying direction; and the calculation unit calculates the skew angle based on a first difference between the first positional information of the first mark and the first positional information of the second mark, and a second difference between the second positional information of the first mark and the second positional information of the second mark.

3. The conveying distance control device as claimed in claim 2, wherein the line sensor includes scanning pixels; and the calculation unit calculates the first positional information of the marks based on positions of the scanning pixels detecting the marks, and calculates the second positional information of the marks based on numbers of lines scanned by the line sensor until the respective marks are detected.

4. The conveying distance control device as claimed in claim 2, wherein the line sensor includes scanning pixels; and the calculation unit calculates the first positional information of the marks based on positions of the scanning pixels detecting the marks, and calculates the second positional information of the marks based on the rotational positions of the conveying roller that are detected by the first detecting unit when the marks are detected by the line sensor.

5. The conveying distance control device as claimed in claim 1, further comprising:

a support part supporting the recording medium, wherein adjustment marks are arranged on the support part in a direction orthogonal to the conveying direction; and the calculation unit calculates correction values for correcting positional measurements of the adjustment marks detected by the line sensor such that the corrected positional measurements of the adjustment marks in the conveying direction fall on a same line in the direction orthogonal to the conveying direction, and corrects the positional information of the marks detected by the line sensor based on the calculated correction values.

6. The conveying distance control device as claimed in claim 1, wherein the control unit determines a first conveying distance error corresponding to a current rotational position of the conveying roller and a second conveying distance error corresponding to a target rotational position of the conveying roller based on the relationships between the conveying distance errors and the rotational positions of the conveying roller, and calculates the correction value based on a difference between the second conveying distance error and the first conveying distance error.

7. The conveying distance control device as claimed in claim 6, wherein the control unit obtains an actual conveying distance of the conveying roller by subtracting the correction value from a theoretical conveying distance of the conveying roller rotated from the current rotational position to the target rotational position, and controls the conveying roller such that the conveying distance of the conveying roller matches the obtained actual conveying distance.

8. A recording apparatus for recording an image on a recording medium with an inkjet recording head, the recording apparatus comprising:

a conveying roller conveying the recording medium;

a first detecting unit detecting rotational positions of the conveying roller;

a line sensor sequentially detecting marks arranged on a test chart being conveyed by the conveying roller;

a calculation unit calculating a skew angle between a line passing through positions of a first mark and a second mark of the marks and a conveying direction of the conveying roller based on positional information of the marks detected by the line sensor; and a control unit obtaining corrected conveying distances by removing errors caused by the skew angle from actual conveying distances of the marks detected by the line sensor, obtaining conveying distance errors indicating differences between the corrected conveying distances and a theoretical conveying distance of the marks in association with the rotational positions of the conveying roller, calculating a correction value for correcting a conveying distance of the conveying roller based on relationships between the conveying distance errors and the rotational positions of the conveying roller, and controlling the conveying distance of the conveying roller based on the calculated correction value.

9. A non-transitory computer-readable storage medium having program code stored therein for causing a conveying distance control device to perform a conveying distance control method, the method comprising the steps of:

detecting, by a first detecting unit, rotational positions of a conveying roller for conveying a recording medium;

sequentially detecting, by a line sensor, marks arranged on a test chart being conveyed by the conveying roller;

calculating, by a calculation unit, a skew angle between a line passing through positions of a first mark and a second mark of the marks and a conveying direction of the conveying roller based on positional information of the marks detected by the line sensor;

obtaining, by a control unit, corrected conveying distances by removing errors caused by the skew angle from actual conveying distances of the marks detected by the line sensor;

obtaining, by the control unit, conveying distance errors indicating differences between the corrected conveying distances and a theoretical conveying distance of the marks in association with the rotational positions of the conveying roller;

calculating, by the control unit, a correction value for correcting a conveying distance of the conveying roller based on relationships between the conveying distance errors and the rotational positions of the conveying roller; and controlling, by the control unit, the conveying distance of the conveying roller based on the calculated correction value.

* * * * *